US008061567B2

(12) United States Patent
Bevans et al.

(10) Patent No.: US 8,061,567 B2
(45) Date of Patent: Nov. 22, 2011

(54) DISPENSER ASSEMBLY FOR A FLUID DISPENSING RECEPTACLE AND METHOD OF ASSEMBLING SAME

(75) Inventors: Russell E. Bevans, Southbury, CT (US); Franco Di Mascio, Pescara (IT); George R. Trepina, Southbury, CT (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 12/839,494

(22) Filed: Jul. 20, 2010

(65) Prior Publication Data

US 2010/0282782 A1 Nov. 11, 2010

Related U.S. Application Data

(63) Continuation of application No. 11/516,276, filed on Sep. 6, 2006, now Pat. No. 7,757,902.

(51) Int. Cl.
*B65D 88/54* (2006.01)

(52) U.S. Cl. ..... 222/321.9; 215/274

(58) Field of Classification Search .... 222/321.1–321.9, 222/153.1, 153.01, 153.04, 153.09, 570, 222/385; 215/274, 275, 280, 289, 292, 298
See application file for complete search history.

(56) References Cited

U.S. PATENT DOCUMENTS 2,723,773 A * 11/1955 Edgeworth ..... 215/29
3,112,048 A * 11/1963 Finkenzeller ..... 222/183
3,973,688 A 8/1976 Kvam
4,073,398 A 2/1978 Schultz
4,251,003 A 2/1981 Bodenmann
4,279,353 A 7/1981 Honma
4,284,211 A * 8/1981 Meshberg ..... 222/182
4,359,166 A 11/1982 Dubach
4,773,553 A * 9/1988 Van Brocklin ..... 215/272
(Continued)

FOREIGN PATENT DOCUMENTS

EP 0 707 895 A3 4/1996
(Continued)

OTHER PUBLICATIONS

"Illustration of Collar With Nomar Edge, Glued Onto Screw-On Closure".

(Continued)

*Primary Examiner* — Lien Ngo
(74) *Attorney, Agent, or Firm* — Wood, Phillips, Katz, Clark & Mortimer

(57) ABSTRACT

A dispensing assembly has a ferrule and collar for maintaining a coupling of a dispensing module to a receptacle neck. The ferrule has an annular plastic skirt open on one end, and plastic nibs extending radially inwardly from the skirt inner surface. The skirt outer surface is a regular polygon with flat surfaces between corners. The collar has a Nomar edge defining an annular recess adjacent the open end with an annular face facing the collar other end. At least the corners of the skirt open end extend radially outwardly into the annular recess of the collar inner surface when the dispensing assembly is secured to the receptacle to retain the collar on the ferrule while the dispensing assembly is secured to the receptacle by the ferrule nibs beneath the flange of the receptacle neck. Installation involves pushing the collar and ferrule onto the receptacle neck with the collar in a raised position on the ferrule, and then pushing the collar down relative to the ferrule.

20 Claims, 38 Drawing Sheets

U.S. PATENT DOCUMENTS

| | | | | |
|---|---|---|---|---|
| 5,096,094 | A | 3/1992 | Guilbert | |
| 5,192,006 | A | 3/1993 | Van Brocklin et al. | |
| 5,299,703 | A * | 4/1994 | Cater | 215/274 |
| 5,348,174 | A | 9/1994 | Velicka | |
| 5,562,219 | A | 10/1996 | de Pous et al. | |
| 5,642,908 | A * | 7/1997 | Mascitelli | 285/148.19 |
| 5,692,650 | A | 12/1997 | Wolter et al. | |
| 5,799,810 | A | 9/1998 | de Pous et al. | |
| 5,941,428 | A | 8/1999 | Behar et al. | |
| 6,253,941 | B1 | 7/2001 | VanBrocklin et al. | |
| 6,409,049 | B1 * | 6/2002 | de Pous et al. | 222/153.09 |
| 6,463,650 | B1 | 10/2002 | Bougamont et al. | |
| 6,543,648 | B2 | 4/2003 | de Pous et al. | |
| 6,619,495 | B1 | 9/2003 | Pares et al. | |
| 6,772,893 | B2 * | 8/2004 | Pares Montaner et al. | 215/274 |
| 6,776,311 | B2 * | 8/2004 | Ackermann | 222/321.7 |
| 6,935,540 | B2 * | 8/2005 | Ackermann | 222/321.7 |
| 7,207,452 | B2 | 4/2007 | Jourdin | |
| 2002/0100742 | A1 | 8/2002 | Jourdin | |

FOREIGN PATENT DOCUMENTS

| | | |
|---|---|---|
| GB | 722642 | 1/1955 |

OTHER PUBLICATIONS

European Search Report in English dated Oct. 6, 2009 for European application No. 07017311.7-2425.

* cited by examiner

DISPENSER ASSEMBLY FOR A FLUID DISPENSING RECEPTACLE AND METHOD OF ASSEMBLING SAME

CROSS REFERENCE TO RELATED APPLICATION(S)

This application is a continuation application of Ser. No. 11/516,276, filed Sep. 6, 2006, and entitled "Dispenser Assembly for a Fluid Dispensing Receptacle and Method of Assembling Same". The full disclosure of that application is hereby incorporated by reference.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to dispensers or dispensing assemblies for receptacles containing fluid products to be dispensed, and the invention is especially suitable for use with bottles containing fragrance fluids or other personal care products.

BACKGROUND OF THE INVENTION AND TECHNICAL PROBLEMS POSED BY THE PRIOR ART

Generally speaking, prior art fragrance dispensers and other personal care product dispensers include a pump or aerosol module with a finger actuator for operating the module. Pump dispensers typically also include at least the following additional components: (1) a ferrule that contains the pump module and crimps onto or otherwise engages the receptacle (e.g., glass bottle, plastic container, or metal can), (2) a gasket that seals the ferrule to the top of the flange on the receptacle's neck (although some dispenser designs do not require a gasket if the ferrule material is soft enough to provide a good seal), and (3) a decorative collar around the ferrule. A cap may also be provided over the finger actuator and collar, either in a slip-fit or a snap-fit arrangement.

Typically, a pump module held in a ferrule is retained on a glass bottle by one of two methods:

(a) the lower edge of the ferrule, typically comprised of aluminum, is collapsed inwardly under the neck flange of the bottle by a crimping tool. Then, the collar is pushed over the ferrule as a separate operation; or (b) the ferrule, made of either plastic or metal, has one or more retention portions that are moved, or retained, under the neck flange of the bottle by sliding the collar down the ferrule. With some designs, the collar and ferrule are initially "preassembled" by the module manufacturer so that the collar is in an "up" shipping position on the upper end of the ferrule, and subsequently the assembly is shipped to the customer (e.g., a fluid product manufacturer) who mounts the assembly on the bottle flange, and then pushes the collar all the way down on the ferrule to move and/or retain the retention portions under the bottle flange.

In either case, the collar can be metal or plastic. Usually, retention of a plastic collar on the ferrule is not a major concern because designs incorporate either snap fits or high force press fits (i.e., "heavy press fits") that do not compromise the outer aesthetics of the collar. However, metal collars are usually fabricated in aluminum and then anodized to produce a lustrous surface. In order to accommodate physical tolerances in the ferrule and collar diameters, the internal surface of the collar may contain multiple, elongated, vertical ribs that project radially inwardly several thousandths of an inch off the inner surface thereof. When the collar is pushed over the ferrule with a heavy press fit, the collar slightly deforms, distorts, or "breathes," into the shape of a polygon, with a resiliency that accommodates the tolerances. Another function of the ribs is to concentrate the "hoop" stress at multiple points, causing the ribs to dig into the ferrule and thus increase the resistance to removal.

However, finding the optimal parameters that provide the best retention and sealing of the module to the receptacle is difficult and heretofore has been elusive. For example, although the press fit over the ferrule must be strong enough to assure that the collar cannot be accidentally pulled off the ferrule, the fit must not be so strong as to damage the outer surface of the collar. The outer surface of the collar is especially susceptible to damage because the anodized surface of the collar is typically a very thin film of aluminum oxide that contains a colorant dye. When stressed in tension, the oxide film can crack, creating a diffraction grating that produces a rainbow effect that detracts from the aesthetics. As a result, the rib locations become evident on the outer surface of the collar, a condition known as "crazing."

Similarly, while the press fit force must be high enough to compress the gasket sufficiently to ensure sealing to the bottle neck so as to avoid leaking, the press fit force should not be so high as to over-compress the gasket, causing it to extrude out from under the ferrule, or create such stresses that the bottle collapses or breaks.

Accordingly, it can be seen that improvements in the art are still desired. Specifically, it is desired to improve the state of the art collars to be able to increase the collar retention force (i.e., the force required to pull a collar off) while also not requiring so much force in initially applying the collar that crazing, bottle leaking, or breaking occurs.

Another proposal that has been used is shown in U.S. Pat. No. 6,253,941, which discloses a ferrule with a continuous skirt having an outwardly projecting lower edge which is deformed inwardly under the rim or flange of the container neck by the bottom portion of the rigid outer collar when the collar is forced down over the ferrule during the assembly process. However, it should be appreciated that the ferrule disclosed in that patent can therefore generally rest loosely on the container rim prior to the collar being pushed down over the ferrule during the assembly process. As a result, the ferrule may undesirably be dislodged or otherwise mis-positioned on the container rim during automated machine assembly.

Still another proposal which has been suggested is shown in U.S. Pat. No. 6,935,540, which describes a collar having angled ribs which facilitate securing of the collar to a ferrule of a dispensing assembly. While the collar such as disclosed therein may be advantageously used with a variety of ferrules, such ferrules may be subjected to some of the same drawbacks as referenced above.

Another improvement that has been suggested is to provide spiraling ribs in the inner surface of the collar, such as described in U.S. Pat. No. 5,799,810. In that structure, the bottom of the ferrule skirt has circumferentially spaced legs or tabs with catches or feet so that the ferrule may be pushed down over the container rim for initial assembly whereby the tabs will flex out to allow the feet to pass the rim and then snap back in when the feet pass the rim, whereby the feet will grip under the rim. The collar is then pushed down over the ferrule so as to trap the tabs and prevent the tabs from being pulled, or flexing, back out—the lowered collar thereby securing the dispensing assembly on the container rim. The spiral ribs on the collar assist in securing the collar on the ferrule, while also permitting the collar to be subsequently twisted off of the ferrule in order to then permit the tabs to flex out as would be necessary to remove the assembly, such as may be desired for recycling the components of a used assembly.

In a typical method of assembling a dispensing package employing the types of collars and ferrules disclosed in the above-discussed U.S. Pat. No. 5,799,810, the pump module is initially snap-fitted into the ferrule. If the ferrule is not itself capable of providing a seal (e.g., if the ferrule material is not soft enough to compress against and seal against the end of the bottle neck), a gasket is disposed inside the ferrule and around the module in a friction fit. Then the metal collar is mounted partially on the ferrule (i.e., the collar is pushed only partway down on the ferrule) in an "up" shipping position or configuration. The dispensing assembly is then shipped to the customer (e.g., a product manufacturer) for mounting to the bottle containing the fluid product. During such shipping and subsequent handling of the dispensing assembly, care must be exercised to avoid knocking the collar into a crooked orientation or off of the ferrule altogether. Thus, it would be desirable to provide an improved dispensing assembly facilitating initial mounting of the collar on the ferrule so that the collar can be initially positioned in the "up," shipping position with an increased retention force while also accommodating subsequent lowering of the collar completely over the ferrule.

It would be beneficial if an improved dispensing assembly for a dispensing package could optionally accommodate incorporation of various aesthetically pleasing designs.

The improved dispensing assembly should preferably also accommodate designs for use with standard or conventional containers, especially glass bottles.

It would also be desirable if the constituent components of such an improved assembly could be relatively easily and economically manufactured with high production quality, and could provide consistent operating parameters unit-to-unit with high reliability.

The present invention is directed toward overcoming one or more of the problems set forth above, and provides an improved system which can accommodate designs having one or more the above-discussed benefits and features.

SUMMARY OF THE INVENTION

The present invention provides components for securing a container of a fluent material product to a dispenser that may include a dispenser cartridge (e.g., a dispensing pump cartridge or an aerosol dispensing valve) having an upwardly projecting, reciprocatable, product-dispensing stem and an attached actuator (e.g., button) through which the product can be discharged.

In a first aspect of the present invention, a set of components is provided for use in a dispensing assembly for dispensing a substance from a receptacle having a neck and a flange. The dispenser assembly includes a ferrule for maintaining a coupling of a dispensing module to the receptacle and a substantially rigid collar. The ferrule includes a shoulder member securable to the dispensing module, a plastic skirt which is generally annular about an axis and defines an axial aperture open on one end (wherein the dispensing module extends through the aperture when secured to the shoulder member), and plastic nibs extending from the inner surface of the skirt toward the axis. The collar has a generally annular inner surface adapted to be positioned over the ferrule skirt outer surface when the ferrule is mounted on the receptacle, and is open on one end with an inwardly extending annular flange on the other end, with the collar inner surface including an annular recess adjacent the open end defining an annular face facing the collar other end. The open one end of the ferrule skirt extends radially outwardly into the annular recess of the collar inner surface when the dispensing assembly is secured to the receptacle.

In one form of this aspect of the present invention, the skirt is continuous.

In a further form of this aspect of the present invention, the annular recess is conically tapered outwardly toward the collar open end, and at least portions of the ferrule skirt outer surface are tapered conically outwardly, wherein the ferrule skirt outer surface portions extend into the collar annular recess when the dispensing assembly is secured to the receptacle.

In a further form of this aspect of the present invention, the dispensing assembly components include a dispensing module secured to the ferrule.

In another form of this aspect of the present invention, the collar has a Nomar edge that is located at the open end and defines the recess and the annular face.

In still another form of this aspect of the present invention, a gasket is adjacent the ferrule shoulder member.

In yet another form of this aspect of the present invention, elongated ribs project inwardly from the collar inner surface and, in a further form, the ribs are angled along the inner surface of the collar. In a still further form, each rib forms an angle of approximately 5 to 15 degrees on the inner surface of the collar relative to the axis.

In another form of this aspect of the present invention, the skirt has an outer surface which, in a plane perpendicular to the axis, is substantially shaped as a regular polygon with flat surfaces between corners. In one further form, the corners are rounded. In another further form, the corners of the ferrule skirt outer surface extend into the collar annular recess when the dispensing assembly is secured to the receptacle. In still another further form, the radius of the ferrule corners from the axis is X, and the radius of the collar inner surface is Z, wherein $X>Z$ prior to assembly of the collar on the ferrule, and in a still further form, the radius at the center of the ferrule flat surfaces from the axis is Y, wherein $Y<Z$. In yet another further form, the radius at the center of the flat surfaces from the axis is Y, and the radius of the collar inner surface is Z, wherein $Y<Z$.

In still another form of this aspect of the present invention, the dispensing module comprises a pump cartridge.

In yet another form of this aspect of the present invention, the collar is made of aluminum.

In still another form of this aspect of the present invention, a lip is on the ferrule outer surface adjacent the other end of the ferrule skirt and a recess is beneath the lip, wherein the lip extends to a diameter greater than the diameter of the collar one end.

In a further form, an assembly is provided of the receptacle and the dispensing assembly as described above.

In a second aspect of the present invention, components are provided for use in a dispensing assembly for dispensing a substance from a receptacle having a neck and a flange. The dispenser assembly includes a ferrule for maintaining a coupling of a dispensing module to the receptacle, and a substantially rigid collar. The ferrule includes a shoulder member securable to the dispensing module, and a skirt which is generally annular about an axis and defines an axial aperture.

The dispensing module when secured to the shoulder extends through the aperture, and the skirt has an outer surface with a lower annular lip, wherein the skirt outer surface in a plane perpendicular to the axis is substantially shaped as a regular polygon with flat surfaces between corners. Nibs extend from the inner surface of the skirt toward the axis. The collar has a generally annular inner surface open on one end with an inwardly extending annular flange on the other end, with the collar inner surface including an annular recess adjacent the open end defining an annular face facing the collar other end, wherein the end of the ferrule skirt is in the annular recess when the dispensing assembly is secured to the receptacle. Further, the radius of the ferrule corners from the axis is X, the radius at the center of the ferrule flat surfaces from the axis is Y, the radius of the collar inner surface is Z, and X>Z>Y prior to assembly of the collar on the ferrule.

In one form of this aspect of the present invention, the skirt is continuous.

In a further form of this aspect of the present invention, the annular recess is conically tapered outwardly toward the collar open end, the ferrule skirt outer surface is tapered conically outwardly at the corners, and the ferrule skirt outer surface outwardly tapered corners extend into the collar annular recess when the dispensing assembly is secured to the receptacle.

In another form of this aspect of the present invention, the dispensing assembly components include a dispensing module secured to the ferrule.

In still another form of this aspect of the present invention, a gasket is adjacent the ferrule shoulder member.

In yet another form of this aspect of the present invention, the corners are rounded.

In another form of this aspect of the present invention, the skirt and nibs are plastic.

In still another form of this aspect of the present invention, elongated ribs project inwardly from the collar inner surface. In a further form, the ribs are angled along the inner surface of the collar and in a still further form, each rib forms an angle of approximately 10 degrees on the inner surface of the collar relative to the axis.

In yet another form of this aspect of the present invention, the dispensing module is a pump cartridge.

In still another form of this aspect of the present invention, the collar is made of aluminum.

In a further form, an assembly is provided of the receptacle and the dispensing assembly as described above.

In a third aspect of the present invention, a method is provided for securing the dispensing assembly of the above described first aspect of the invention to a receptacle having a neck and a flange, including (a) locating the ferrule on the receptacle flange with the dispensing module extending into the receptacle, (b) pushing the ferrule over the receptacle flange to locate the ferrule nibs beneath the receptacle flange, and (c) pushing the collar over the ferrule skirt to trap the nibs beneath the flange.

In a further form of this aspect of the present invention, a lip is on the ferrule with a recess beneath the lip, and (a1) the locating step includes supporting the collar on the ferrule lip, (b1) the ferrule pushing step includes pushing the collar while the collar is located on the ferrule lip to move both the collar and the ferrule relative to the receptacle flange, and (c1) the collar pushing step includes pushing the collar relative to the ferrule to push the material of the ferrule lip into the recess beneath the lip.

In another aspect of the present invention, a method is provided for securing the dispensing assembly of the above described second aspect of the invention to a receptacle having a neck and a flange, including (a) locating the ferrule on the receptacle flange with the dispensing module extending into the receptacle, (b) pushing the ferrule over the receptacle flange to locate the ferrule nibs beneath the receptacle flange, (c) pushing the collar over the ferrule skirt to compress the corners of the skirt and trap the nibs beneath the flange, wherein the collar is pushed sufficiently to position the collar annular face beneath the ferrule collar skirt, and (d) terminating the pushing of the collar.

In a further form of this aspect of the present invention, a lip is on the ferrule with a recess beneath the lip, and (a1) the locating step includes supporting the collar on the ferrule lip, (b1) the ferrule pushing step includes pushing the collar while the collar is located on the ferrule lip to move both the collar and the ferrule relative to the receptacle flange, and (c1) the collar pushing step includes pushing the collar relative to the ferrule to push the material of the ferrule lip into the recess beneath the lip.

In a still further form of this aspect of the present invention, a gasket is positioned between the ferrule shoulder member and the receptacle flange in the ferrule locating step, and the collar is pushed sufficiently to compress the gasket in the collar pushing step.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 15 is viewed across two of the diametrically opposite corners of the ferrule corresponding to the cross-sectional view of the ferrule shown in FIG. 9;

FIG. 17 is viewed across two of the flat regions of the ferrule corresponding to the cross-sectional view of the ferrule shown in FIG. 10;

FIG. 30 is viewed across two of the diametrically opposite corners of the ferrule corresponding to the cross-sectional view of the ferrule shown in FIG. 9;

FIG. 32 is viewed across two of the flat regions of the ferrule corresponding to the cross-sectional view of the ferrule shown in FIG. 10;

DETAILED DESCRIPTION OF THE INVENTION

Figure 1:
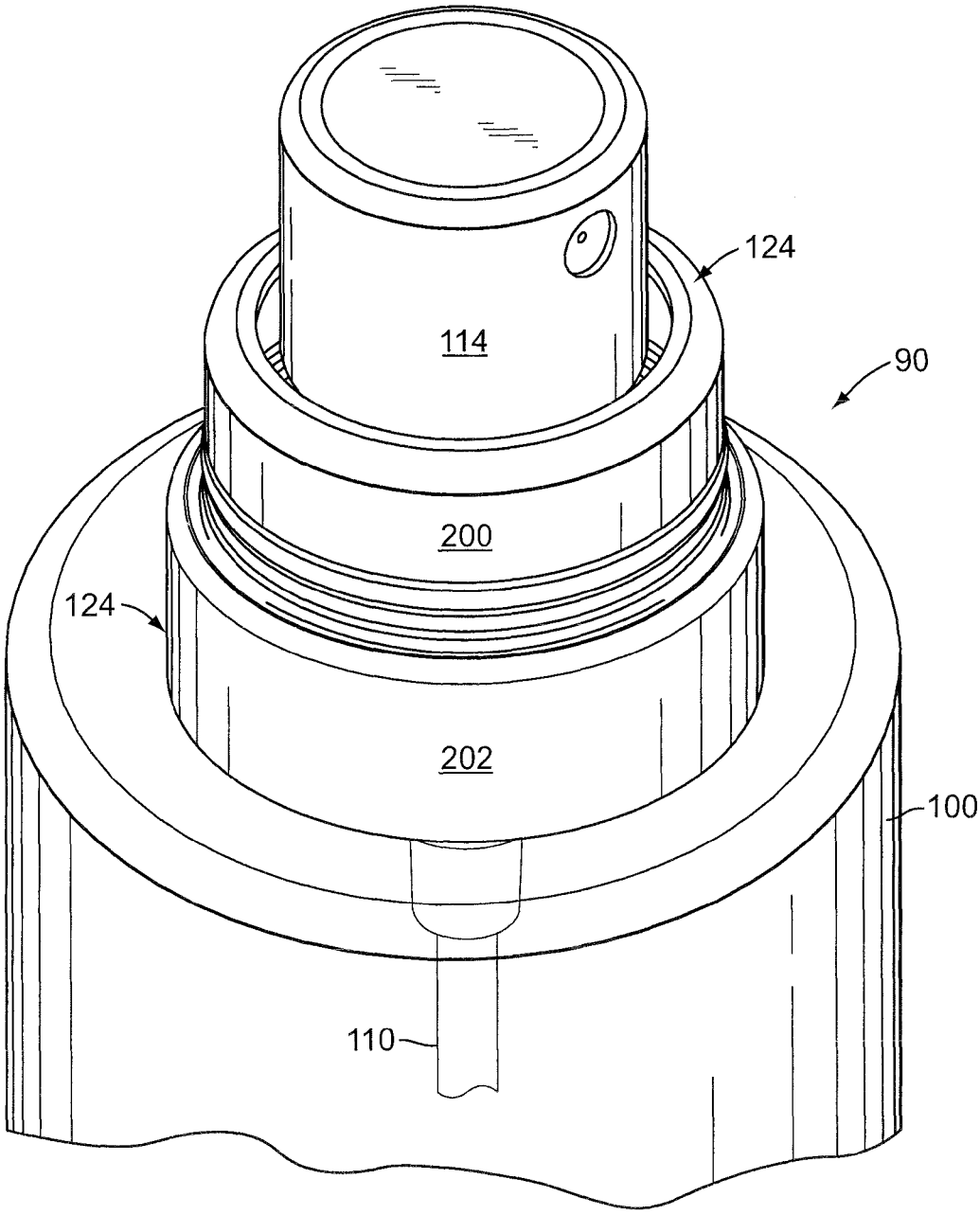
FIG. 1 is a fragmentary, isometric view of a hand-holdable dispensing package incorporating a glass bottle and a first embodiment of a finger-actuatable dispensing pump assembly, and the package is shown with the dispensing pump assembly in an unactuated condition prior to use and without the installation of a dust cap or overcap.

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the components of this invention and the container employed with the components of this invention are described in the normal (upright) operating position, and terms such as upper, lower, horizontal, etc., are used with reference to this position. It will be understood, however, that the components embodying this invention may be manufactured, stored, transported, used and sold in an orientation other than the position described.

Figures illustrating the components of this invention and the container show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

The present invention provides an improved system for mounting a fluid dispensing module to a container. One presently preferred form of the invention is especially adapted for mounting a dispensing module in the form of a finger-operable, spray pump cartridge to a glass bottle that is particularly suitable for perfumes. However, the broad aspects of the invention are not limited to a particular dispensing module. Further, although the detailed design of the dispensing module forms no part of the broad aspects of the present invention, a brief discussion of some common types of dispensing modules is next presented below.

Finger-operable dispensing modules or dispensers (which can include, for example, both dispensing pumps and aerosol dispensing valves) are typically adapted to be mounted on hand-held containers that are commonly used for liquid products. Typically, some pumps and valves operate with a suitable discharge structure, such as a mechanical break-up unit, to produce a fine mist or atomized spray of the liquid product (e.g., perfume). Some pumps also operate to dispense a quantity of product in a liquid, cream, or paste form.

Some finger-operable pumps conventionally employ a dispensing module in the form of a pump cartridge having a chamber in which is disposed a pressurizing piston that can be actuated by the user's finger pressing down on an external actuator (e.g., button) which has a dispensing passage and which is connected to the piston with a hollow discharge tube or stem (which may typically be molded as a unitary part, or extensions of, the piston). The hollow stem establishes communication between the pump chamber and actuator from which the product is discharged. A spring acts against the piston or actuator to return the piston and actuator upwardly to the elevated, rest position when the finger pressing force is released.

Like the above-discussed pump type dispensers, aerosol valve dispensers are typically mounted at the top of a container, such as a metal can containing a pressurized product. Conventional aerosol valve dispensing systems for a container have a dispensing module that includes a hollow body which is open at the top and bottom ends and which is mounted in the top of the container. The bottom end of the hollow body is open to the pressurized contents in the container (usually through a dip tube connected to the bottom end opening in the aerosol valve body). A compression spring in the body biases a stem upwardly to project partly out of a body top end opening through an annular gasket at the top of the body. The upper part of the stem includes an internal, vertical discharge hole that is open at the upper end of the stem and that is connected to an external actuator button which has a dispensing passage from which the aerosol spray can be dispensed. Below the upper end of the stem, the stem has one or more lateral orifices which communicate with the vertical discharge hole inside the stem. Until the actuator button is pressed, the lateral orifices in the stem are located adjacent the inner cylindrical vertical surface of the annular gasket at the top of the valve body, and fluid inside the valve body is blocked by the gasket from flowing into the stem lateral orifices. When the actuator button is depressed, the stem is forced downwardly against the spring so as to locate the lateral orifices in the body below the gasket to permit the pressurized fluid in the valve body to flow through the stem lateral orifices, up the stem vertical hole, and through the actuator button.

Reference will now be had to the Figures and preferred embodiments incorporating the present invention providing an improved system for mounting a fluid dispensing module to a container. Some presently preferred forms of the present invention are described hereinafter as incorporated in a dispensing assembly that employs a dispensing module in the form of a finger-operable spray pump cartridge mounted on a glass bottle.

Figure 2:
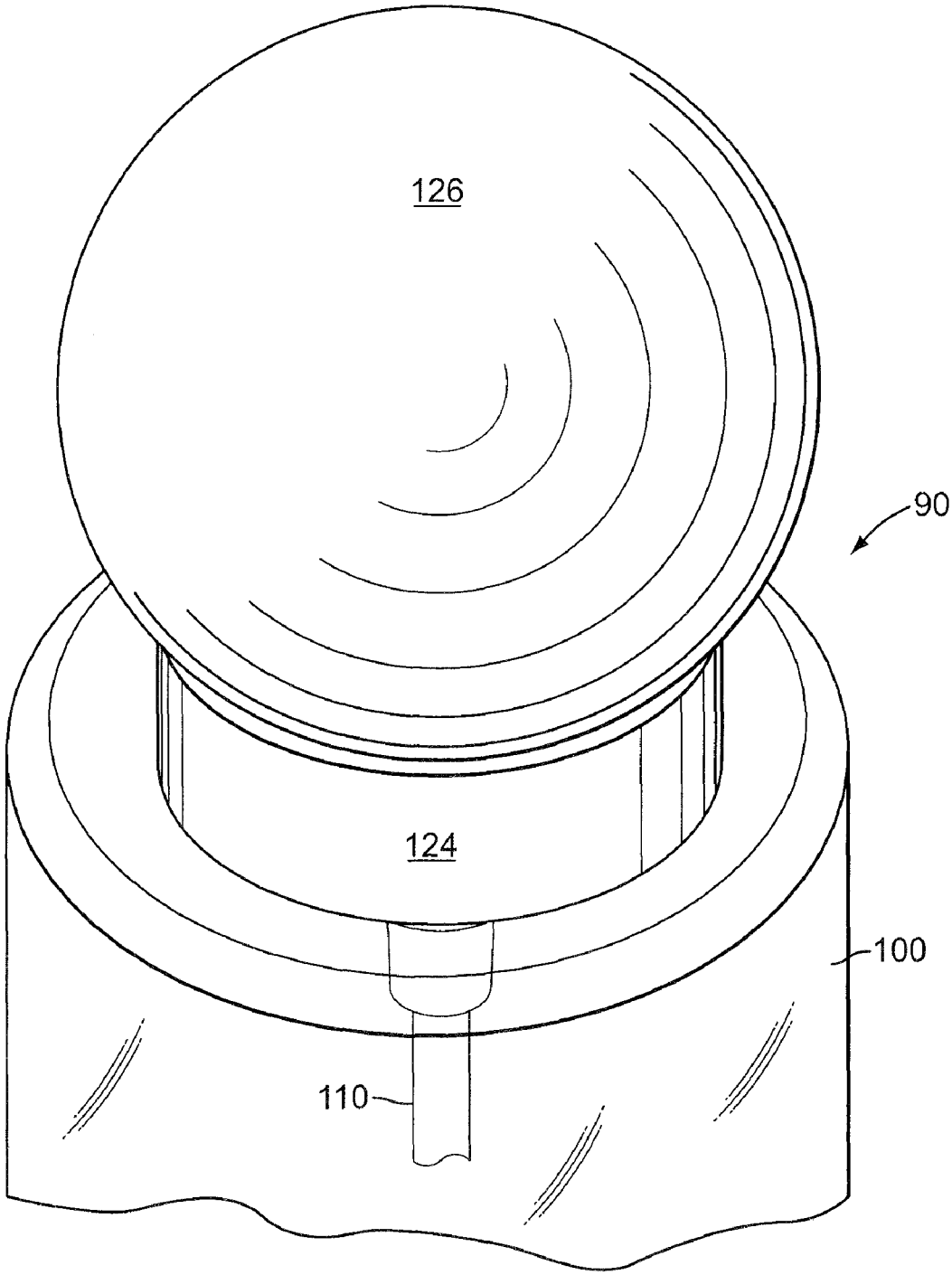
FIG. 2 is a view similar to FIG. 1, but FIG. 2 shows the dust cap or overcap installed.
Figure 3:
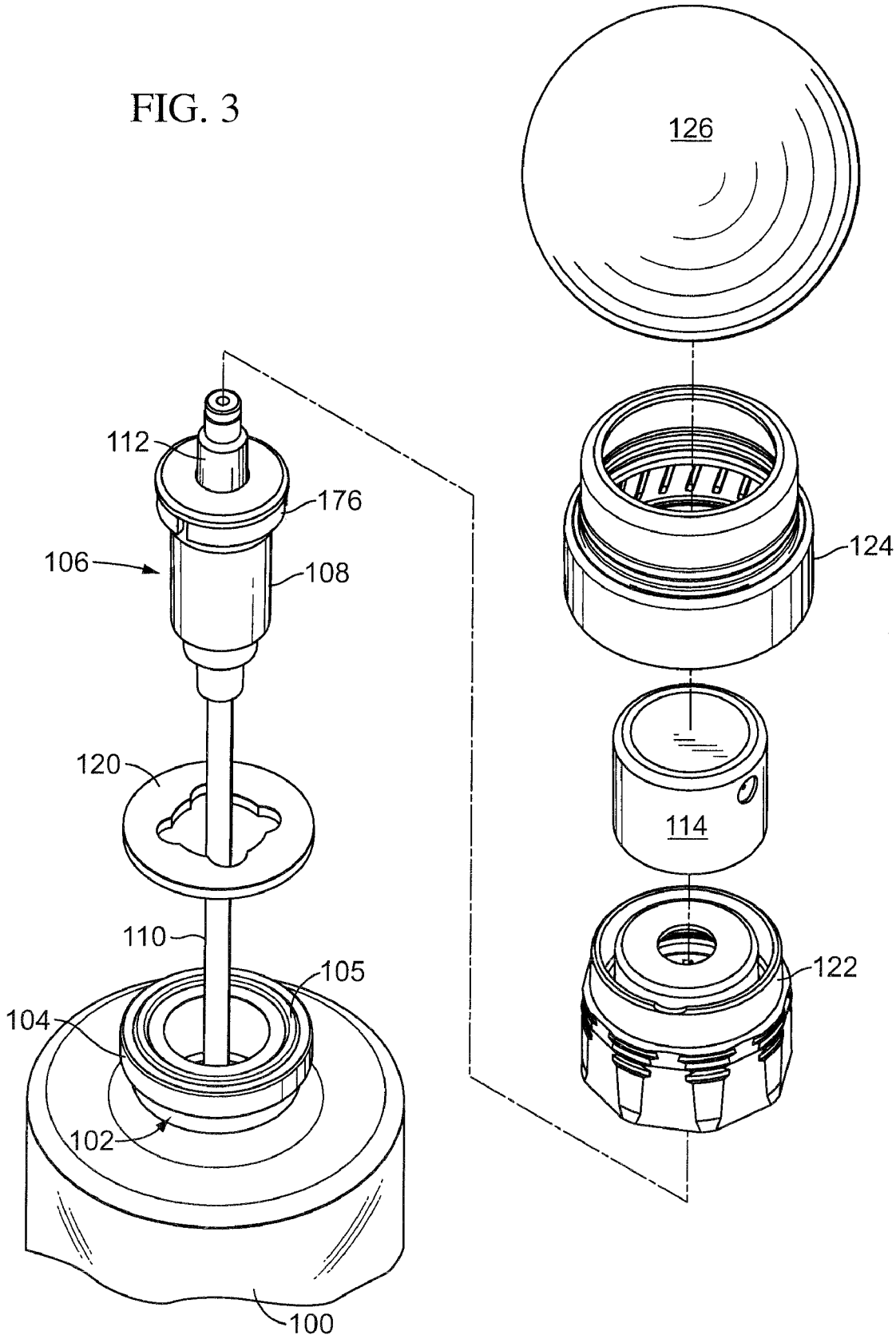
FIG. 3 is a fragmentary, exploded, isometric view of the package illustrated in FIG. 2.
Figure 4:
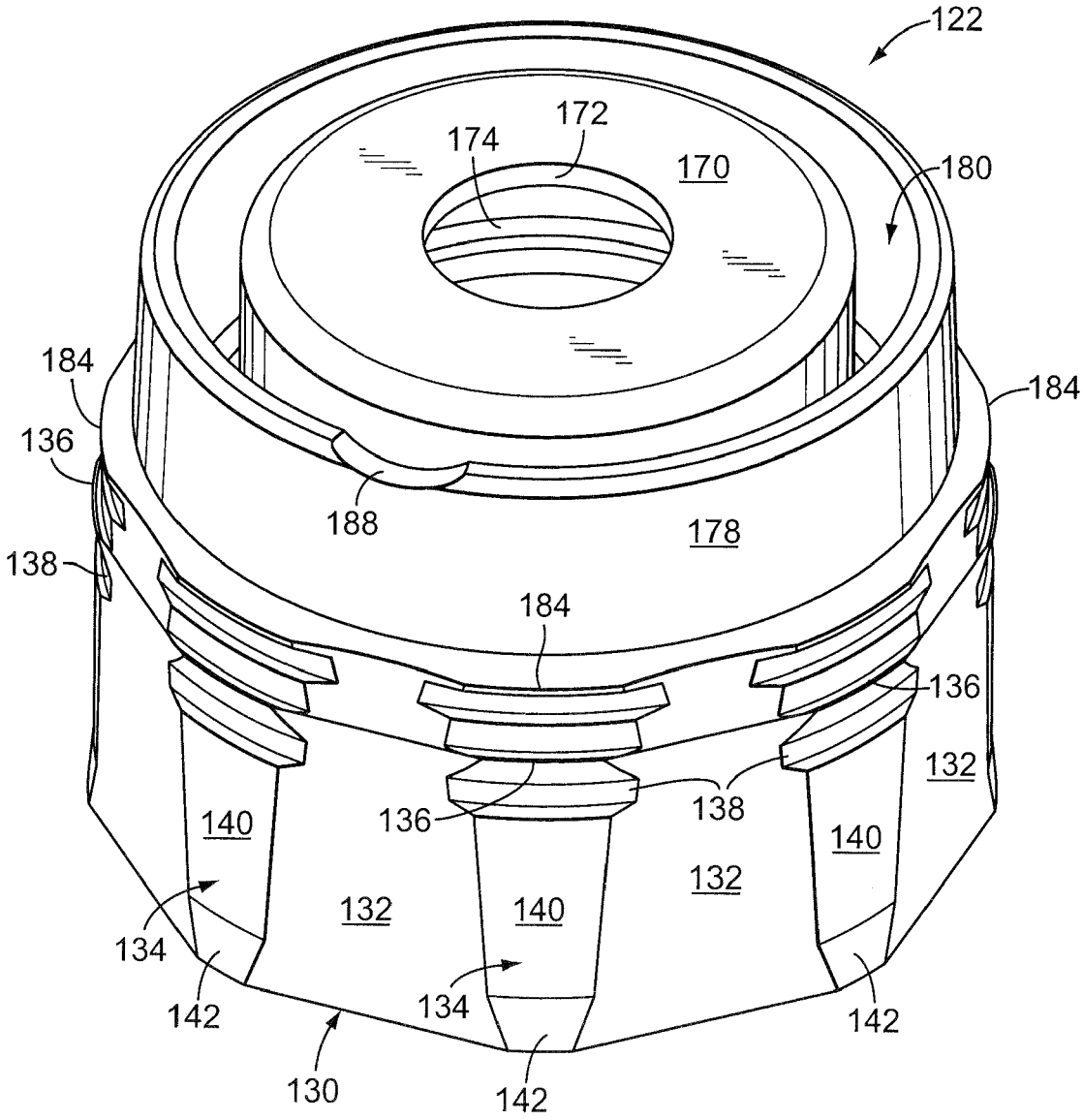
FIG. 4 is an isometric view of the ferrule of the dispensing pump assembly shown in FIG. 3 from a vantage point generally above, or from the top of, the ferrule.
Figure 5:
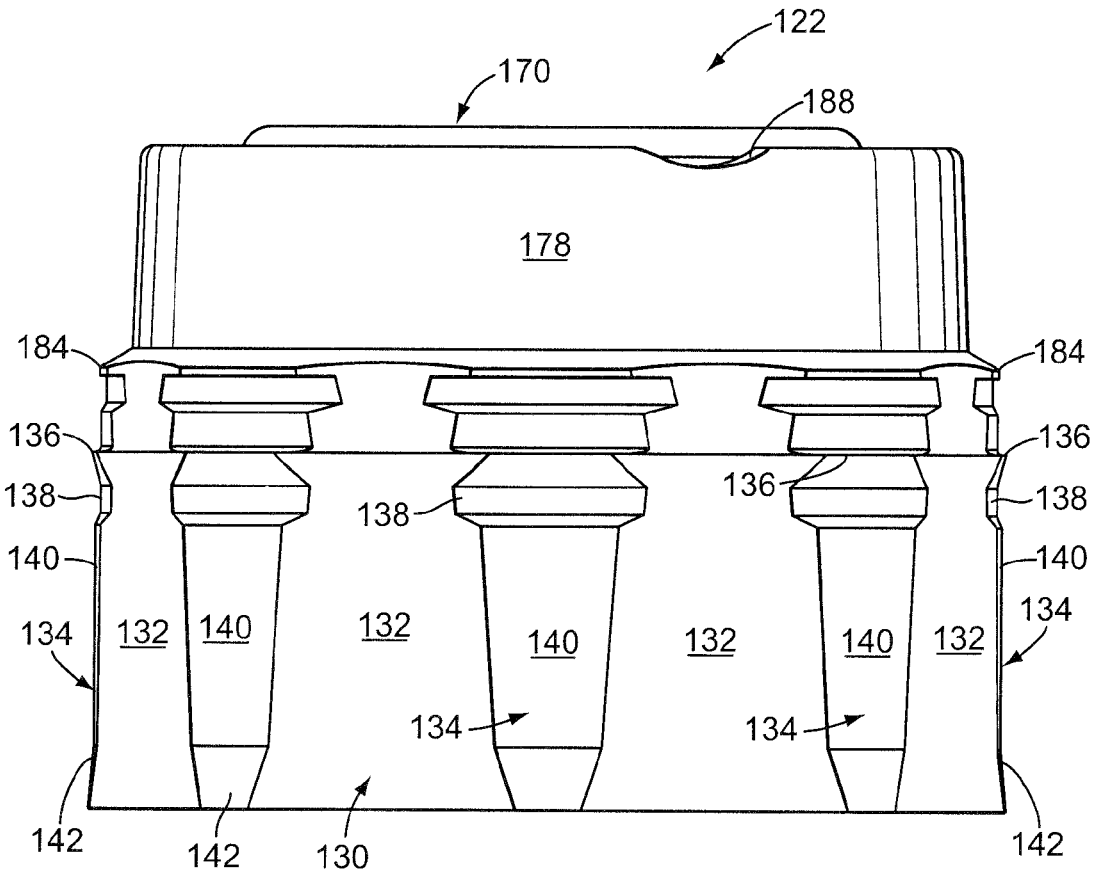
FIG. 5 is an elevational view of the side of the ferrule shown in FIG. 4 as viewed directly toward one of eight corners of a lower portion of the ferrule.
Figure 6:
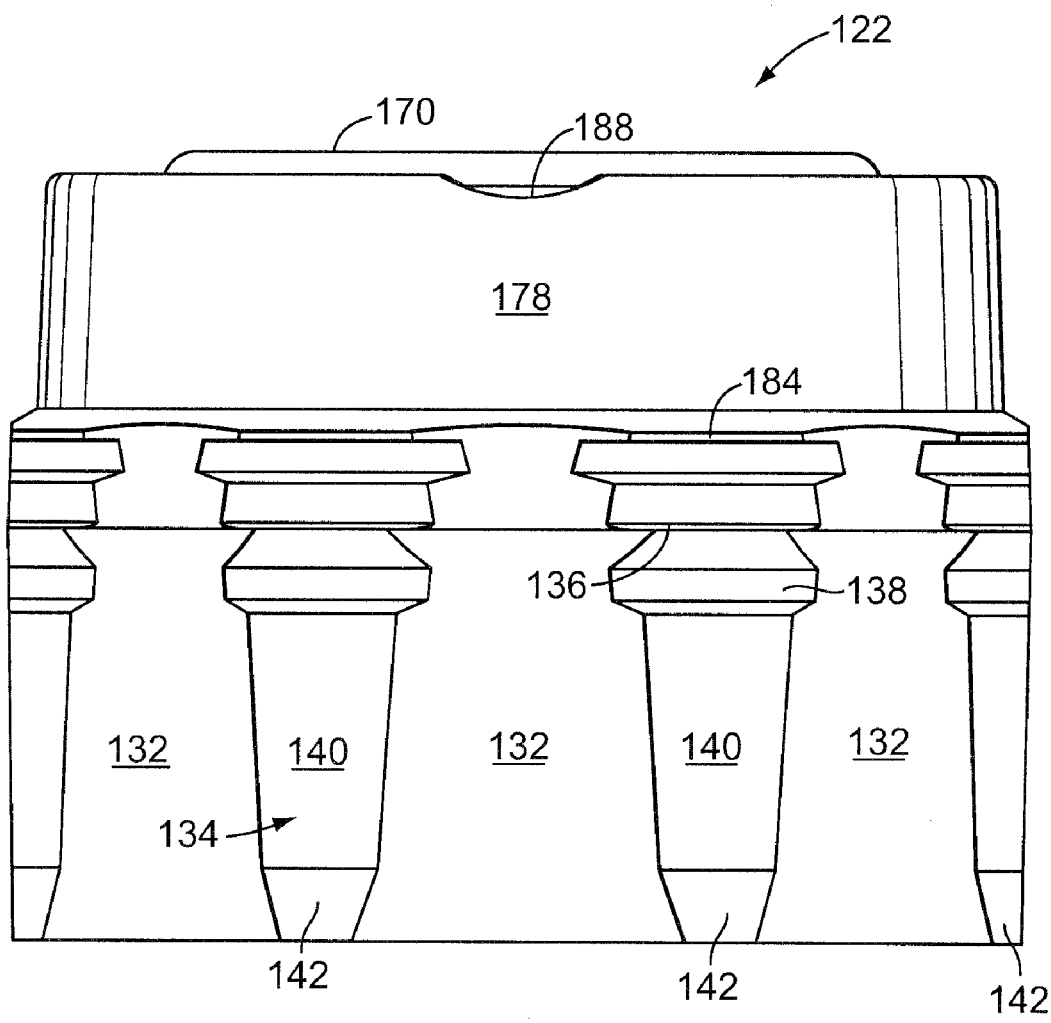
FIG. 6 is a view similar to FIG. 5, but FIG. 6 shows the ferrule rotated toward the left about 22.5 degrees.
Figure 19:
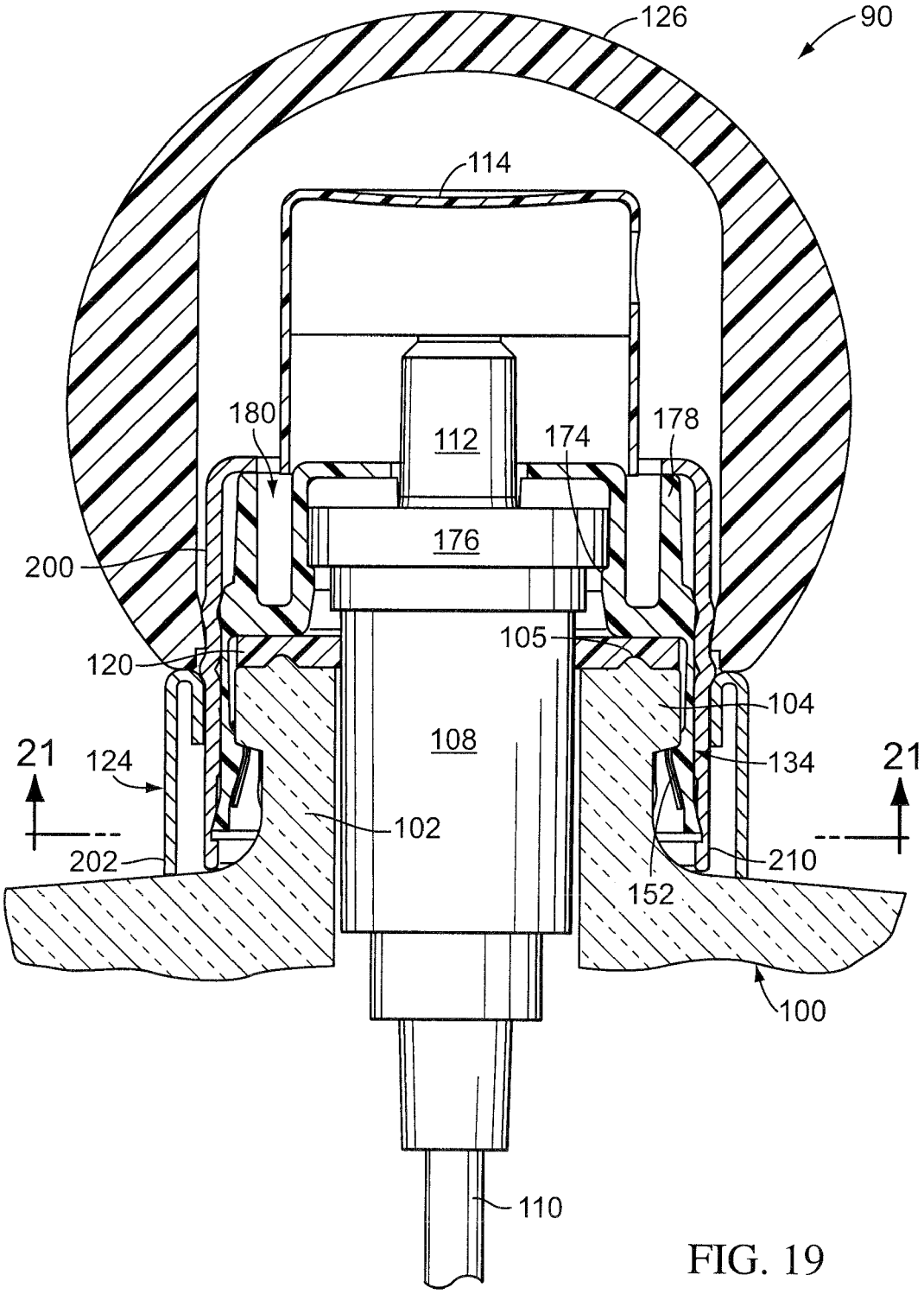
FIG. 19 is a view similar to FIG. 15, but FIG. 19 shows the dispensing pump assembly mounted on the bottle shown in FIG. 2.
Figure 20:
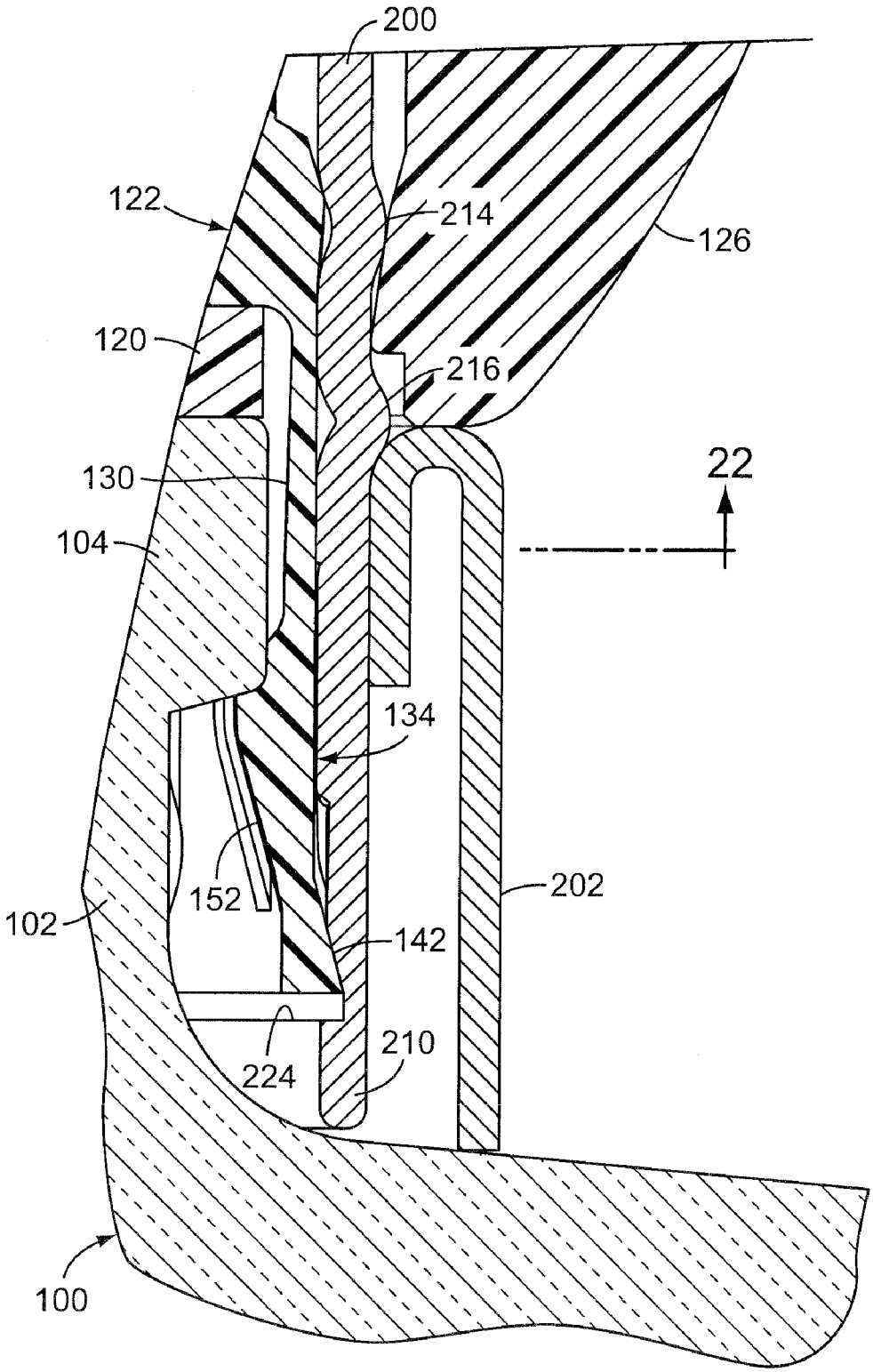
FIG. 20 is a fragmentary, more greatly enlarged, cross-sectional view of a right-hand portion of the dispensing pump assembly and bottle shown in FIG. 19.
Figure 21:
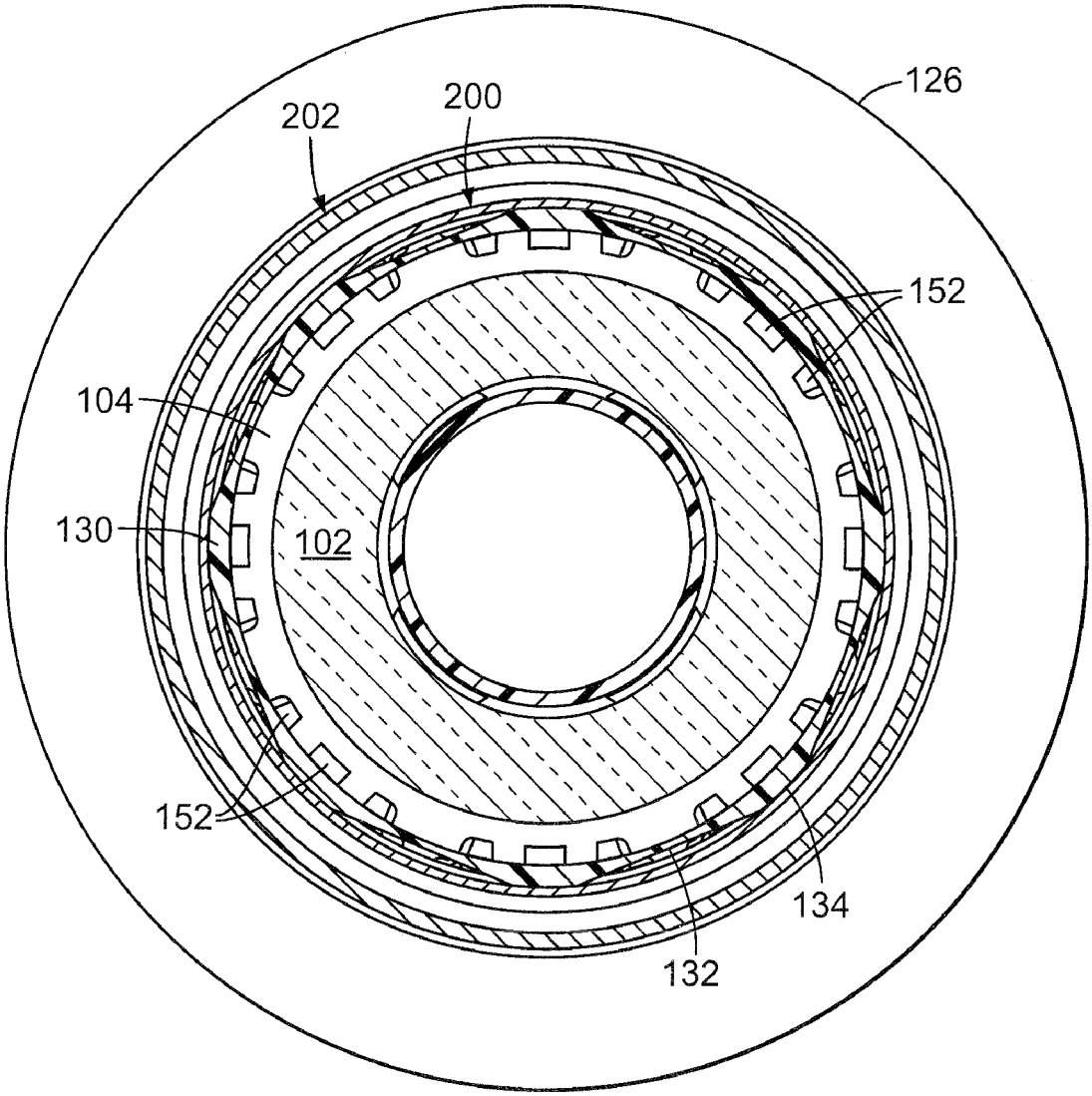
FIG. 21 is a cross-sectional view taken generally along the plane 21-21 in FIG. 19.
Figure 22:
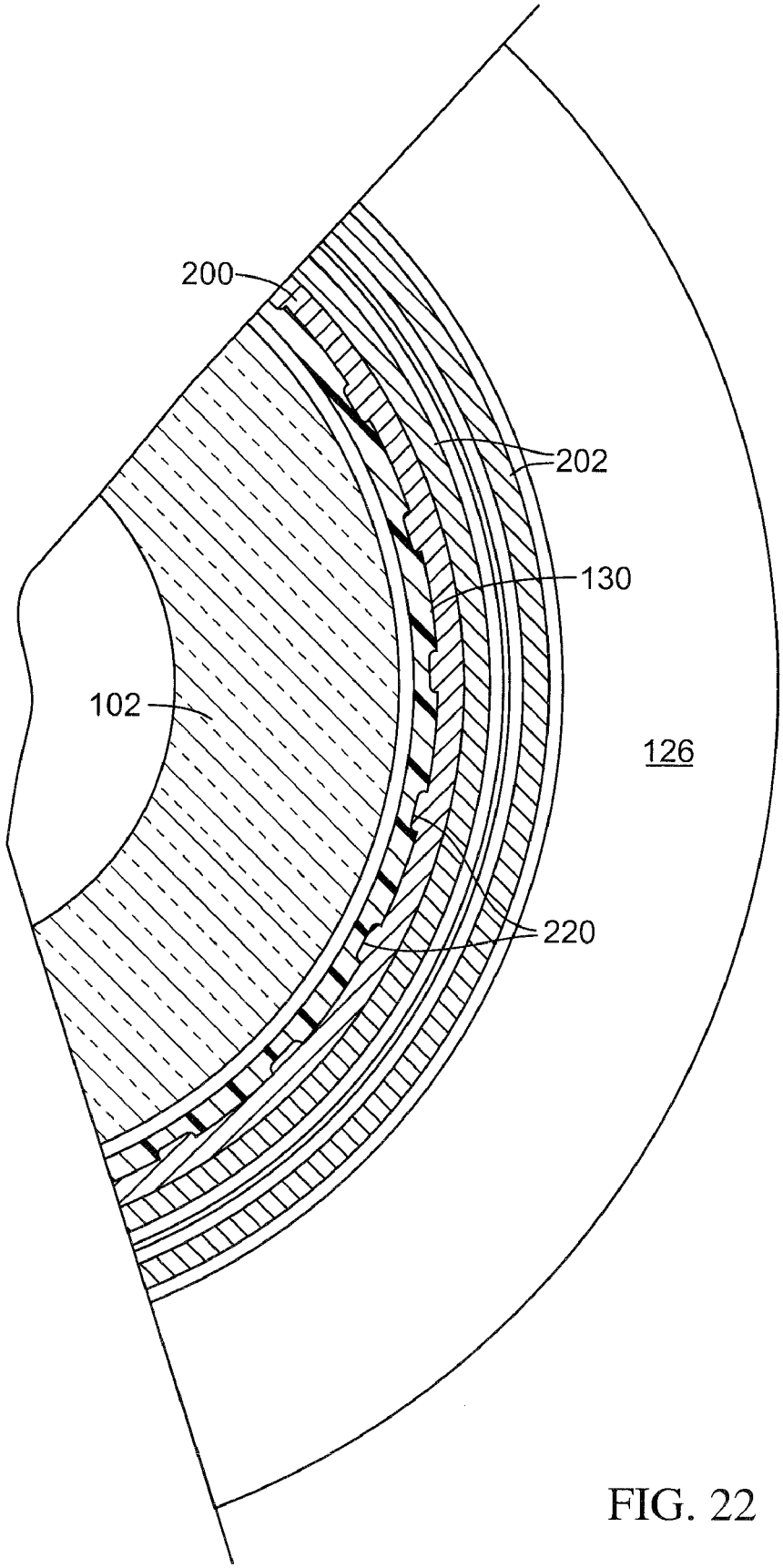
FIG. 22 is a fragmentary, cross-sectional view taken generally along the plane 22-22 in FIG. 20.
Figure 23:
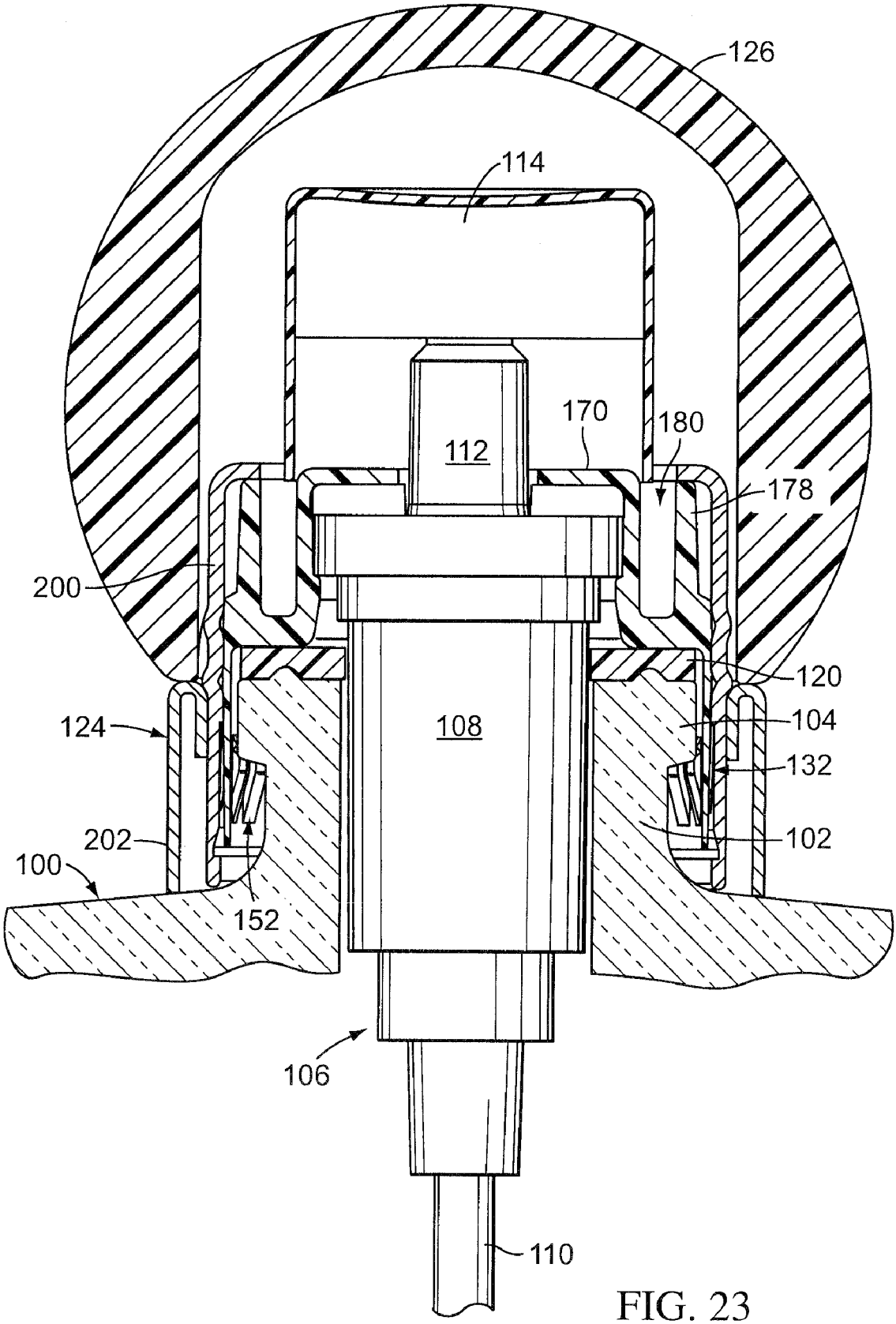
FIG. 23 a view similar to FIG. 17, but FIG. 23 shows the dispensing pump assembly mounted on the bottle shown in FIG. 2.
Figure 24:
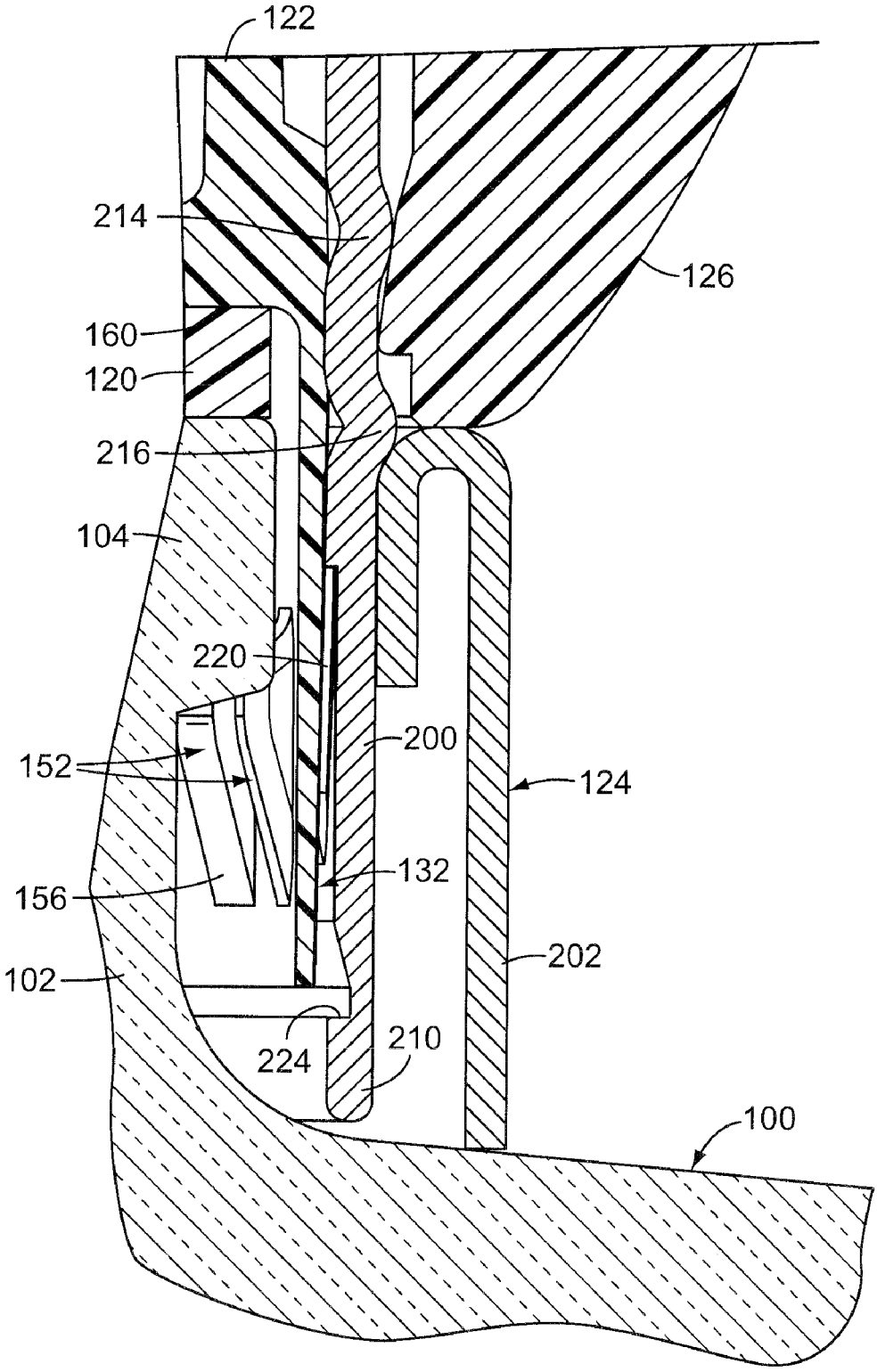
FIG. 24 is a fragmentary, even more greatly enlarged, cross-sectional view of a right-hand portion of the dispensing pump assembly and bottle shown in FIG. 23.
Figure 25:
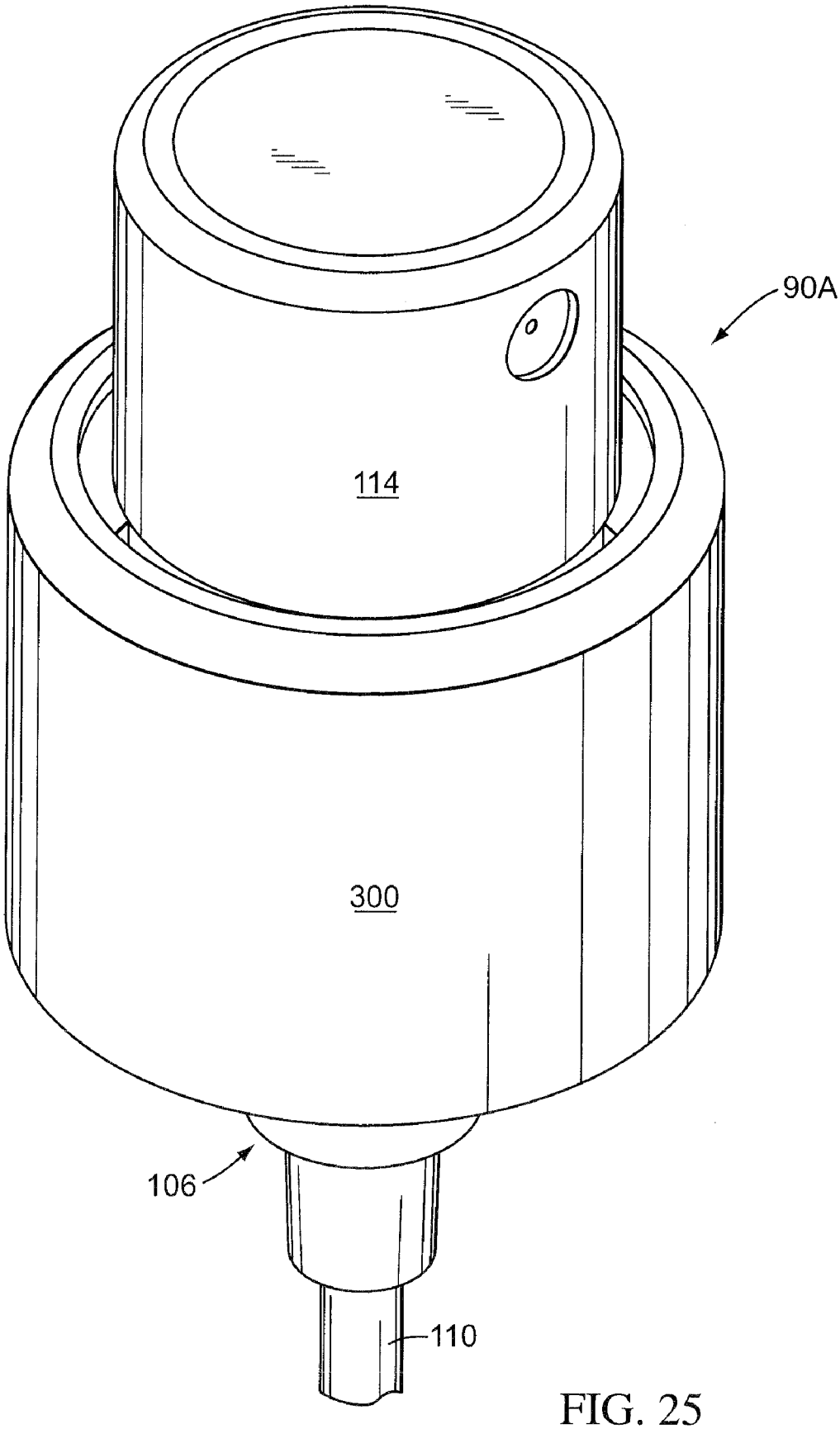
FIG. 25 is a fragmentary, isometric view of a hand-holdable dispensing package incorporating a glass bottle and a second embodiment of a finger-actuatable dispensing pump assembly, and the package is shown with the second embodiment of the dispensing pump assembly in an unactuated condition prior to use and without the installation of a dust cap or overcap.
Figure 26:
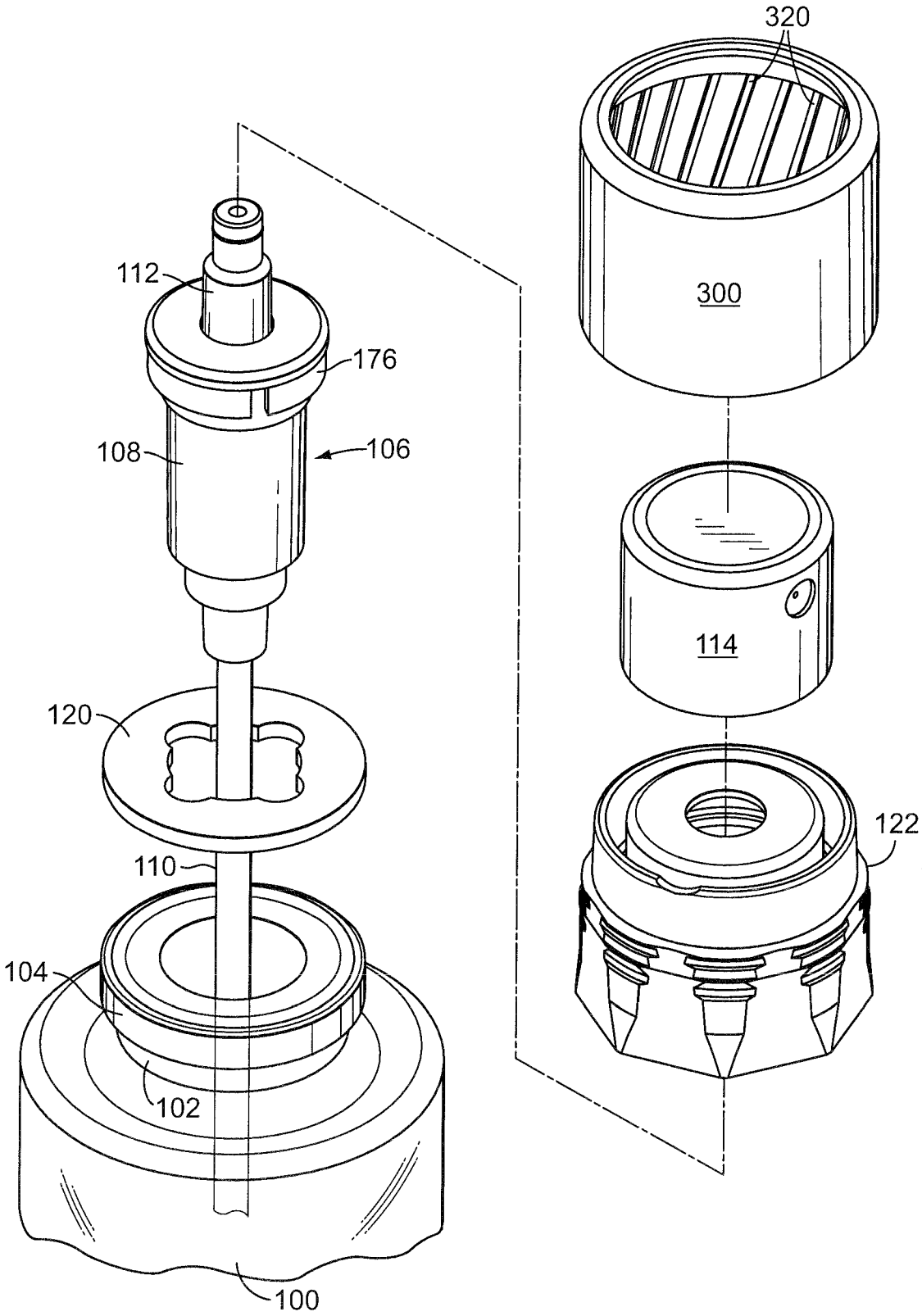
FIG. 26 is a fragmentary, exploded, isometric view of the package illustrated in FIG. 25.
Figure 27:
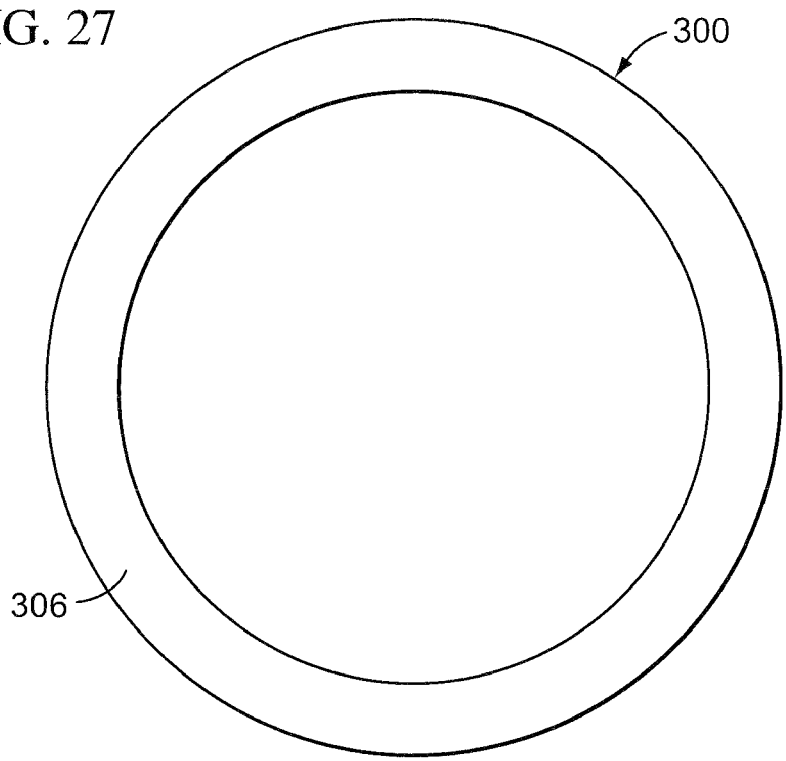
FIG. 27 is a top, plan view of the collar shown in FIG. 26.
Figure 28:
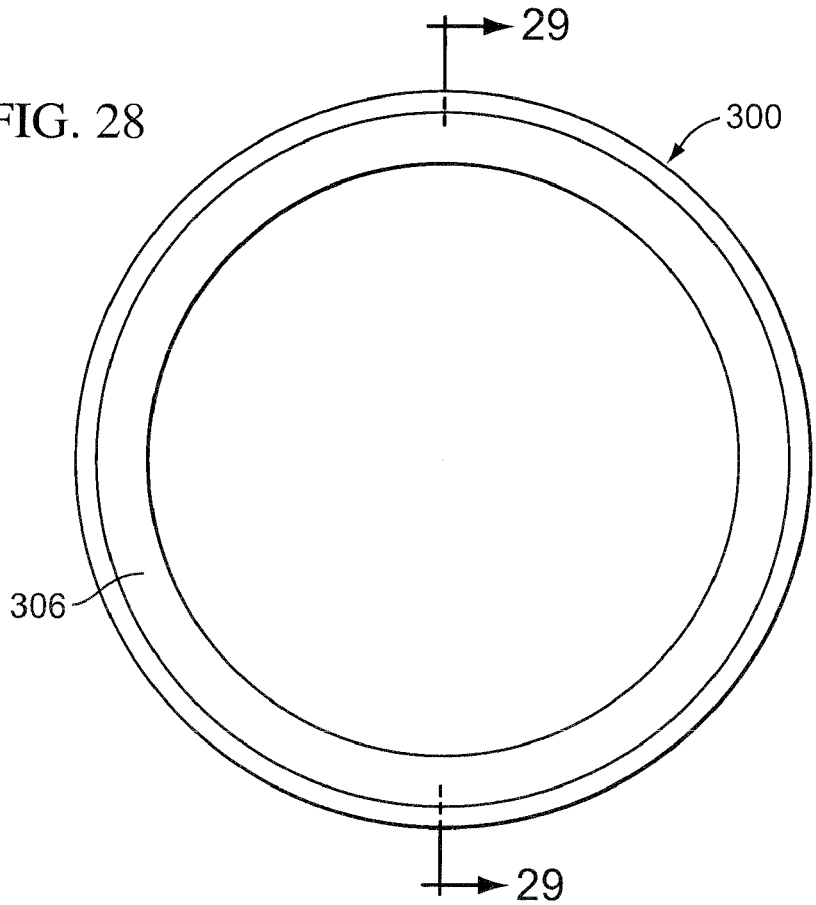
FIG. 28 is a bottom view of the collar shown in FIG. 26.
Figure 29:
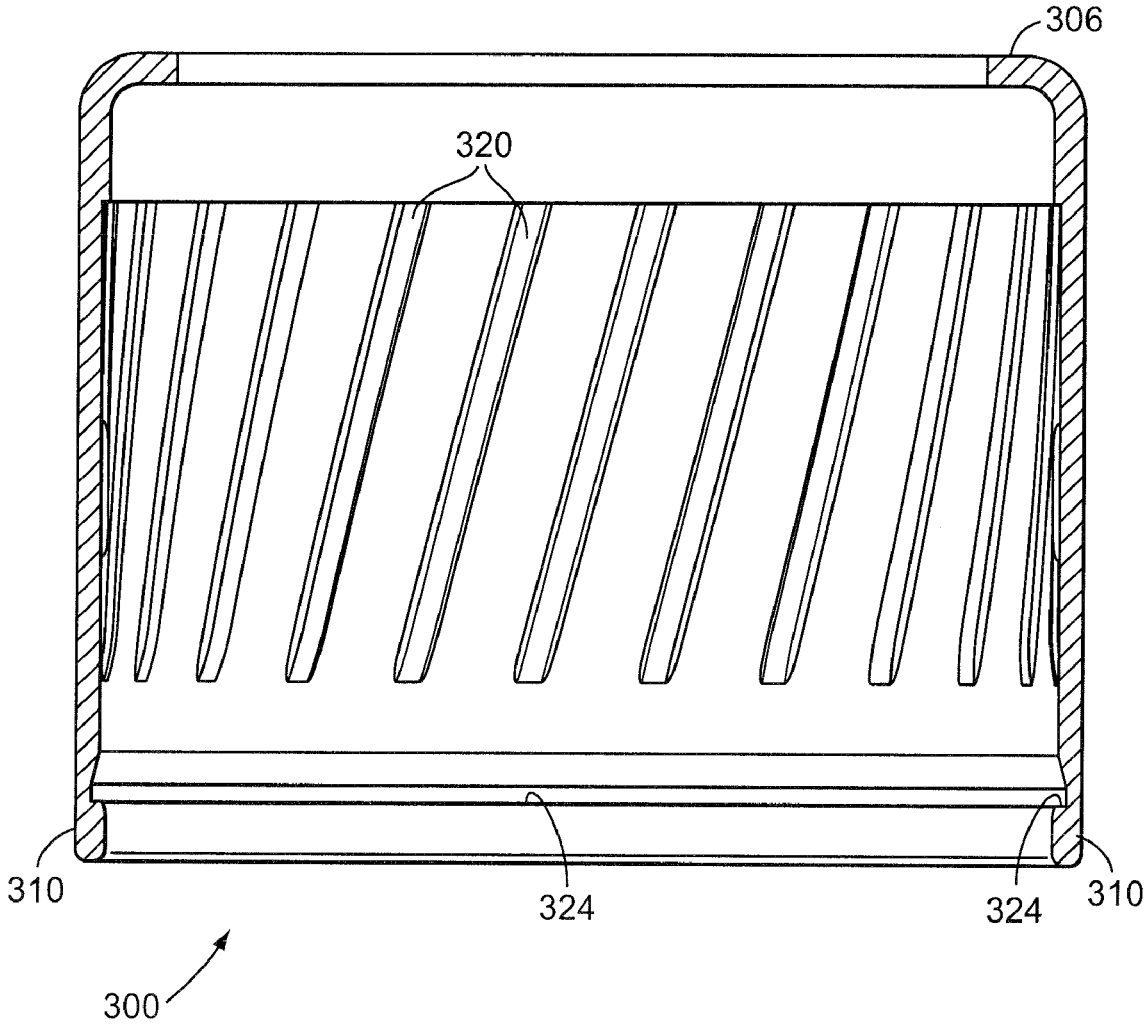
FIG. 29 is an enlarged, cross-sectional view taken generally along the plane 29-29 in FIG. 28.
Figure 30:
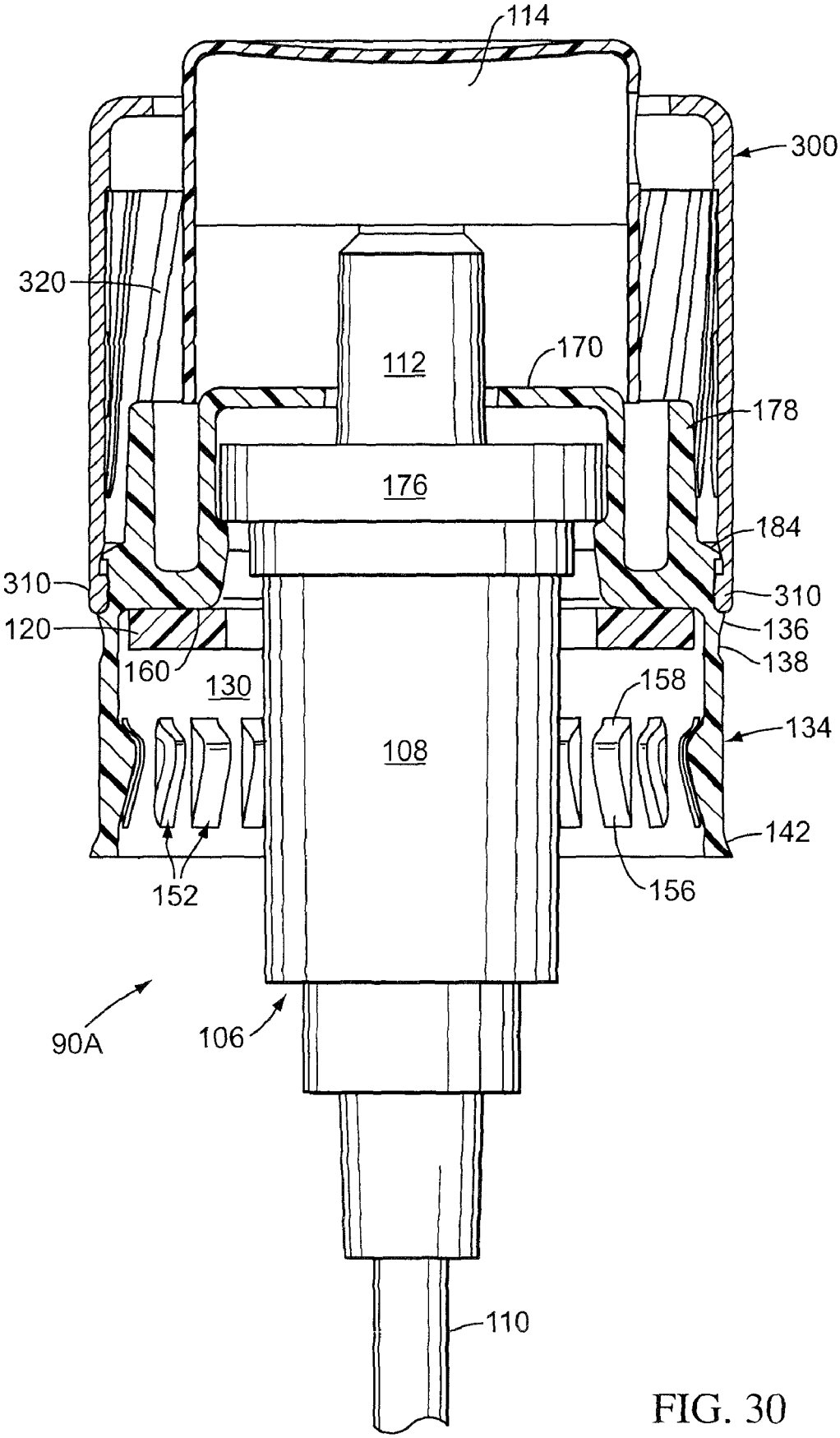
FIG. 30 is an enlarged, fragmentary, longitudinal, cross-sectional view of the second embodiment of the dispensing pump assembly components in an assembled shipping configuration prior to mounting on the bottle, except that FIG. 30 shows the internal dispensing pump cartridge and dip tube in a side, elevational view.
Figure 31:
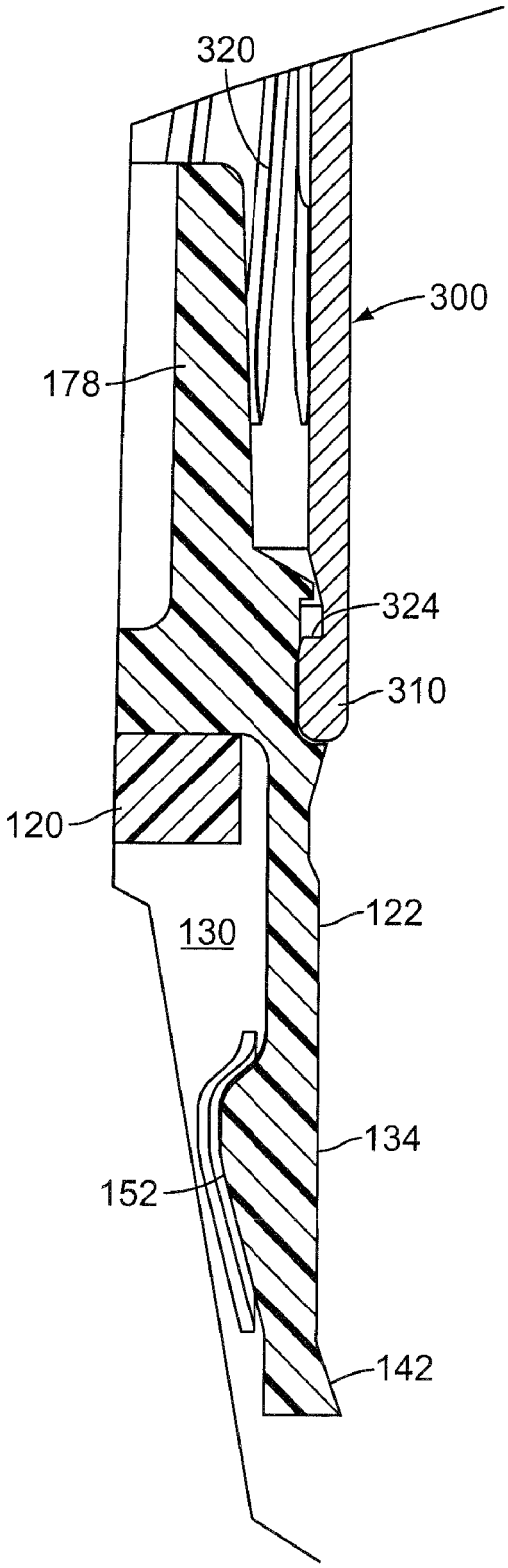
FIG. 31 is a fragmentary, greatly enlarged, cross-sectional view of a right-hand portion of the dispensing pump assembly shown in FIG. 30.
Figure 32:
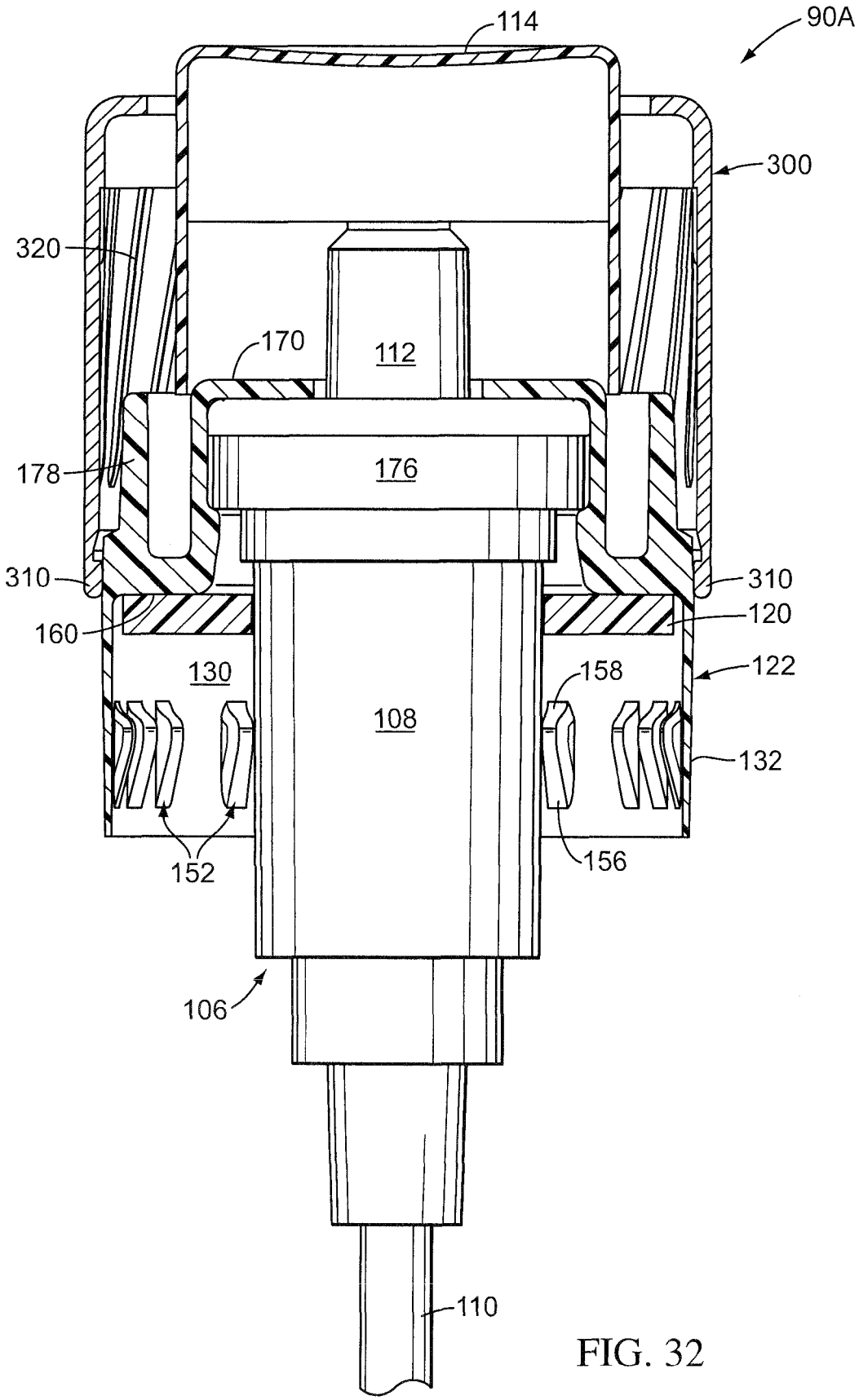
FIG. 32 is an enlarged, fragmentary, longitudinal, cross-sectional view of the second embodiment of the dispensing pump assembly components in an assembled shipping configuration prior to mounting on the bottle, except that FIG. 32 shows the internal dispensing pump cartridge and dip tube in a side, elevational view.
Figure 33:
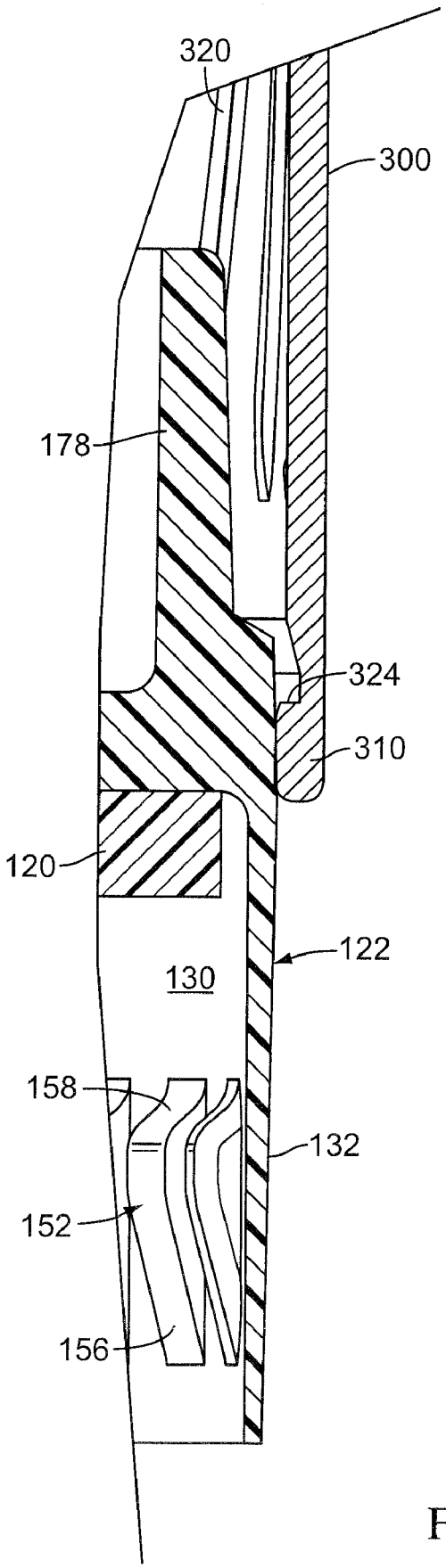
FIG. 33 is a fragmentary, greatly enlarged, cross-sectional view of a right-hand portion of the dispensing pump assembly shown in FIG. 32.
Figure 34:
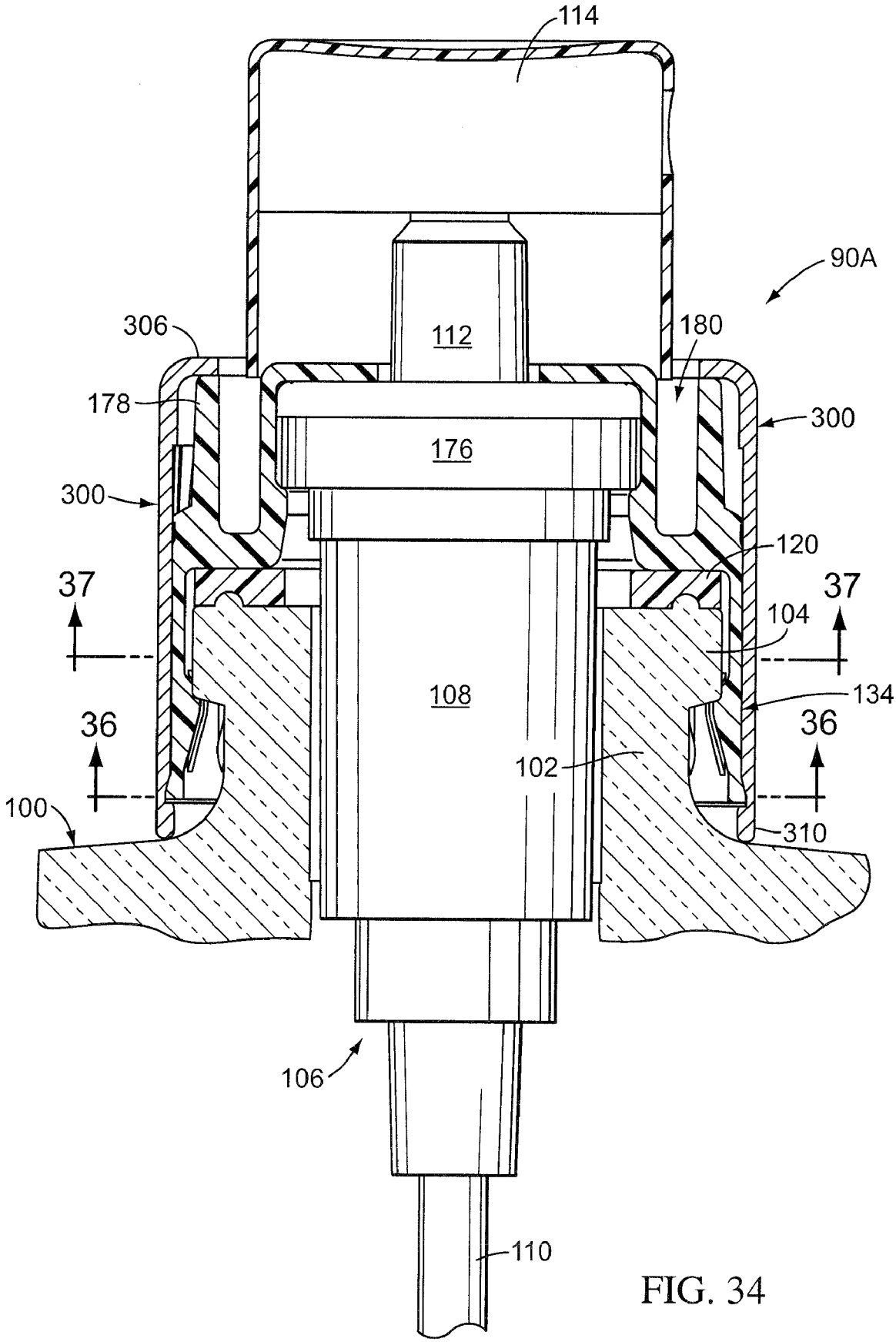
FIG. 34 is a view similar to FIG. 30, but FIG. 34 shows the dispensing pump assembly mounted on the bottle shown in FIG. 25.
Figure 35:
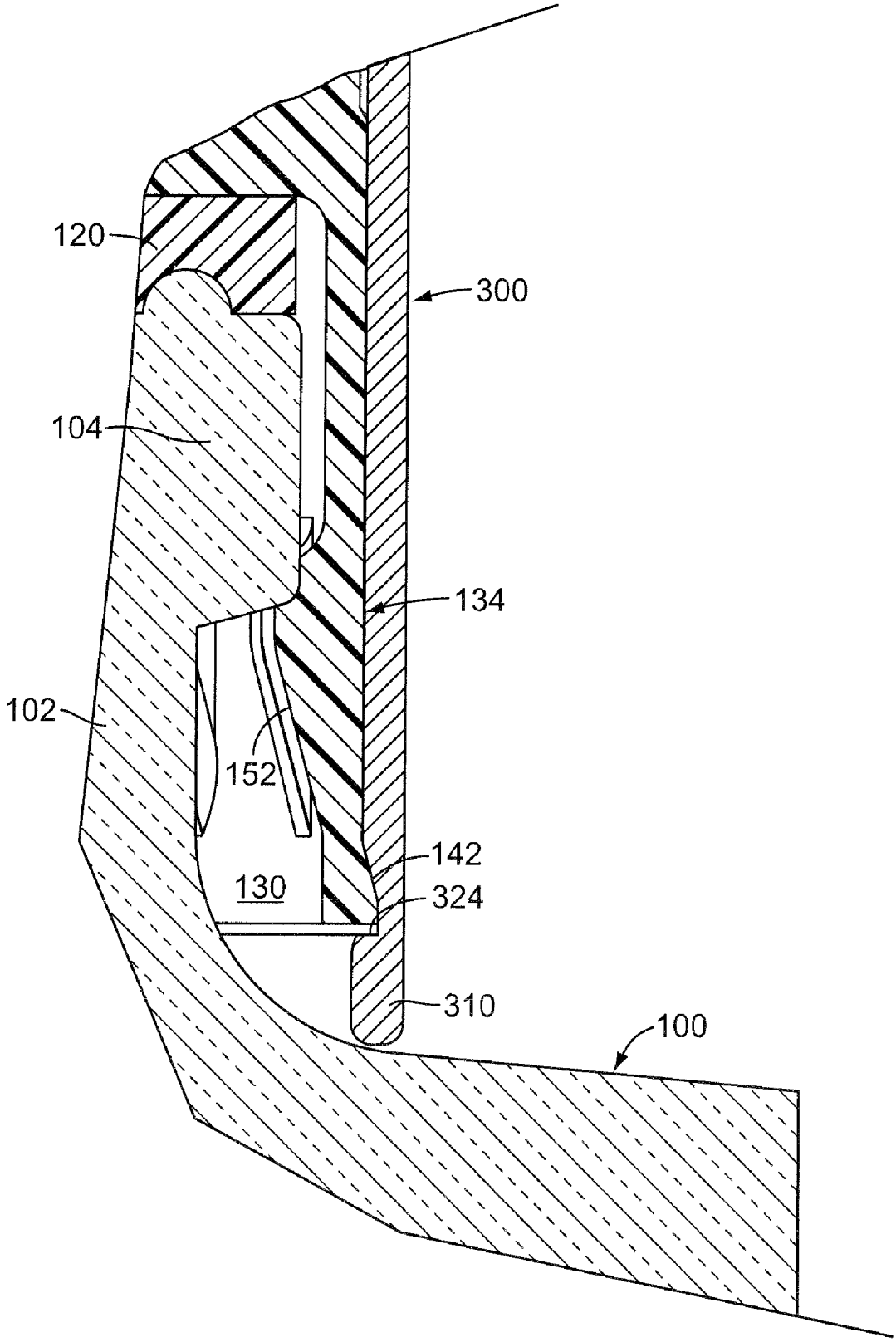
FIG. 35 is a fragmentary, more greatly enlarged, cross-sectional view of a right-hand portion of the dispensing pump assembly and bottle shown in FIG. 34.
Figure 36:
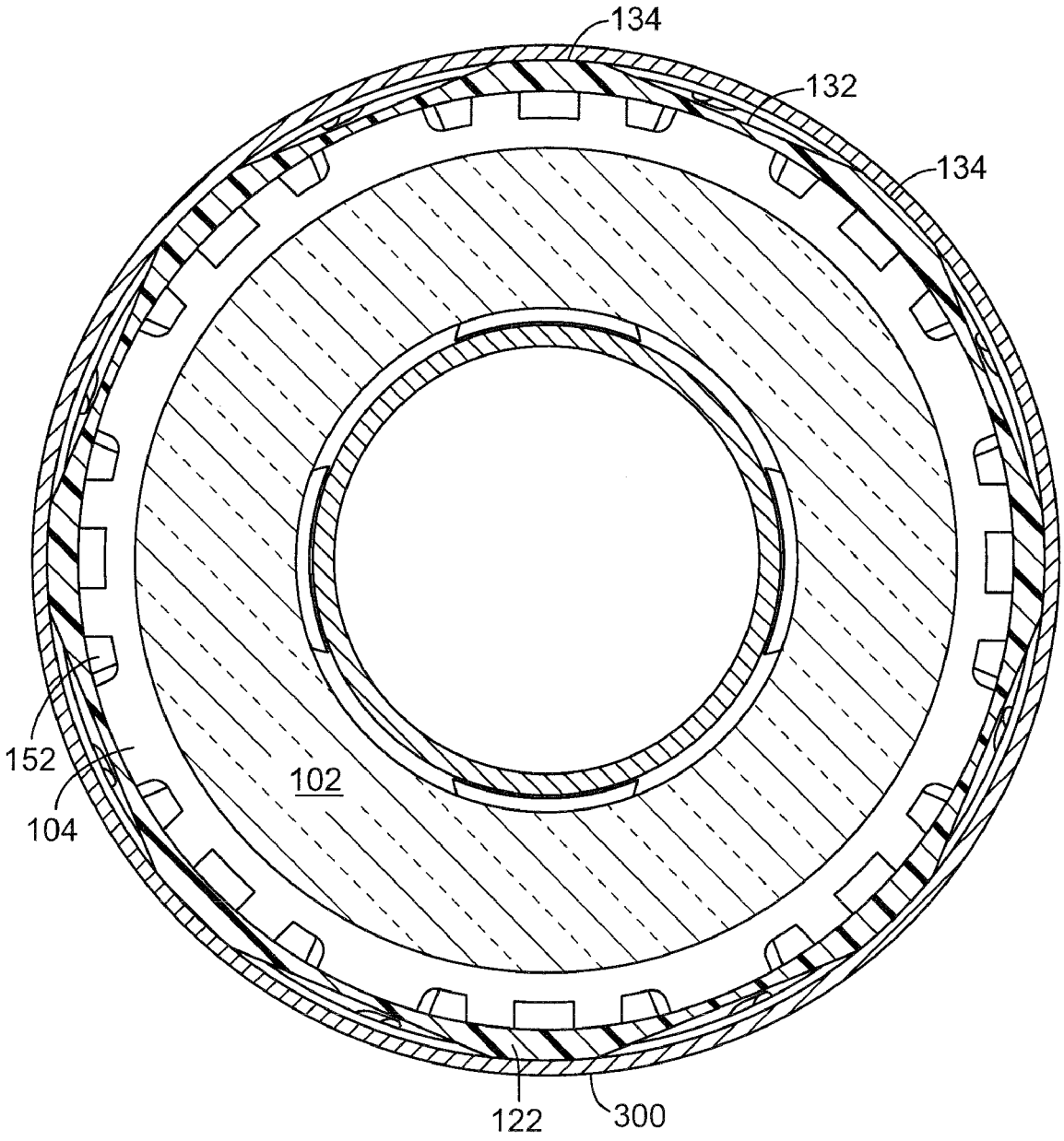
FIG. 36 is a cross-sectional view taken generally along the plane 36-36 in FIG. 34.
Figure 37:
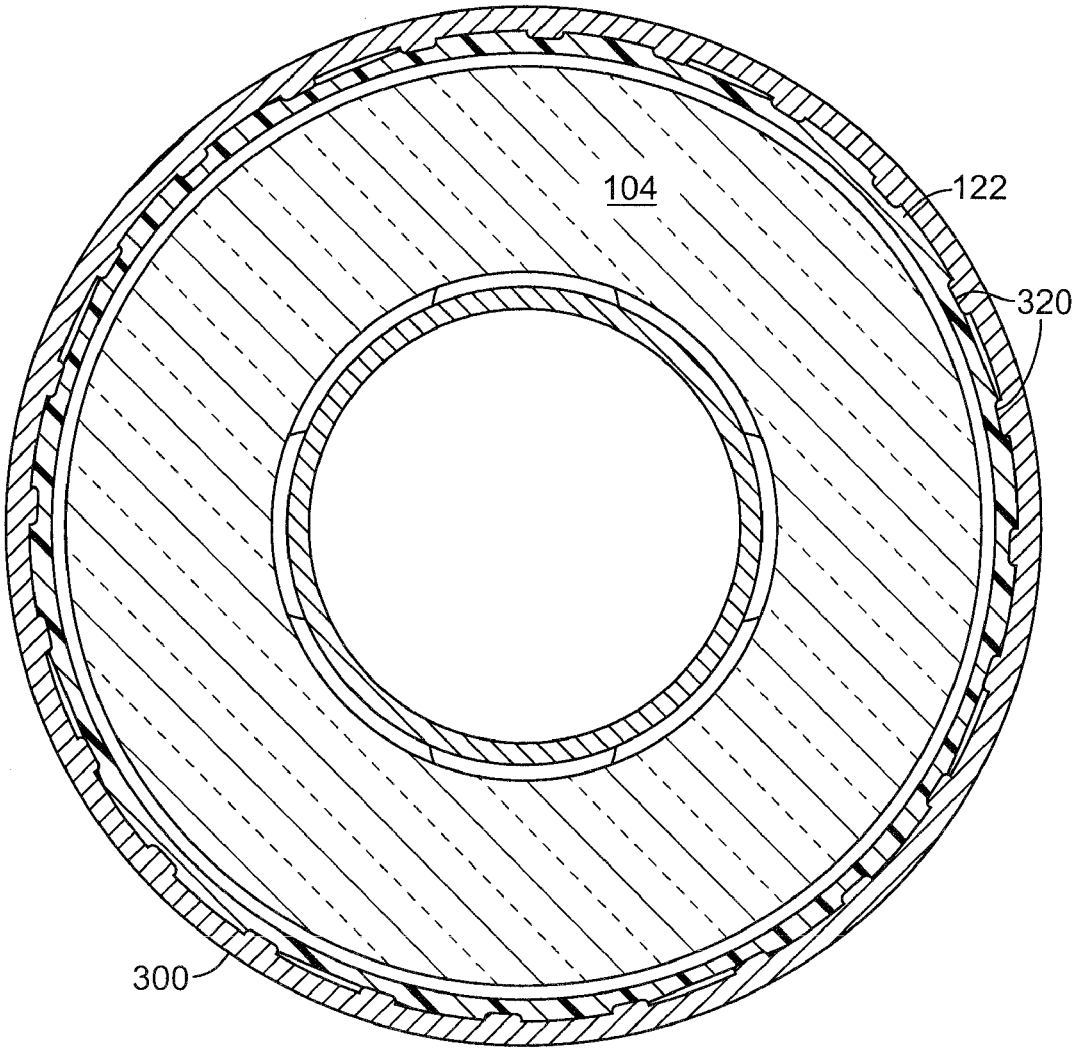
FIG. 37 is a fragmentary, cross-sectional view taken generally along the plane 37-37 in FIG. 34.
Figure 38:
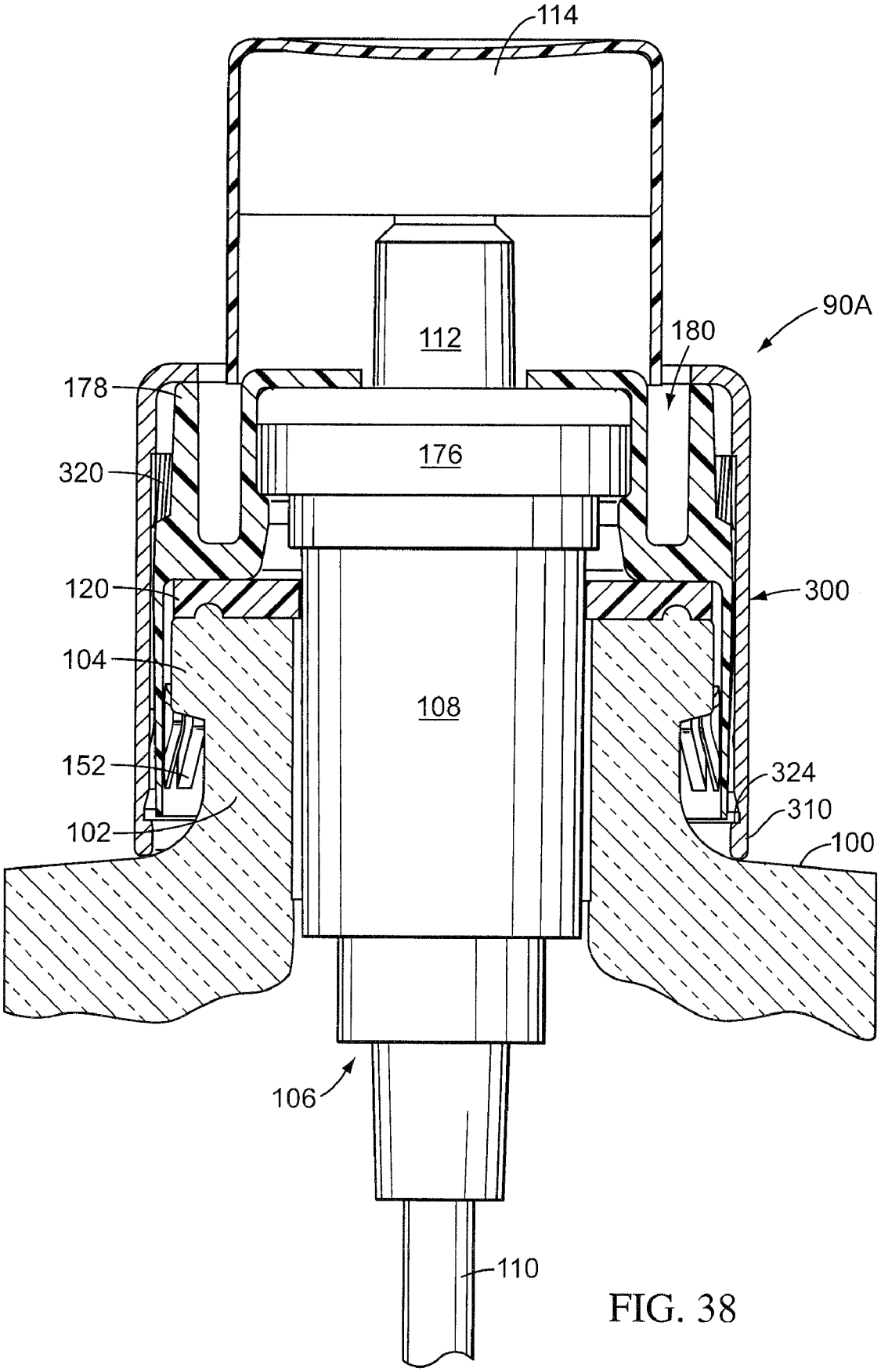
FIG. 38 a view similar to FIG. 32, but FIG. 38 shows the dispensing pump assembly mounted on the bottle shown in FIG. 25.
Figure 39:
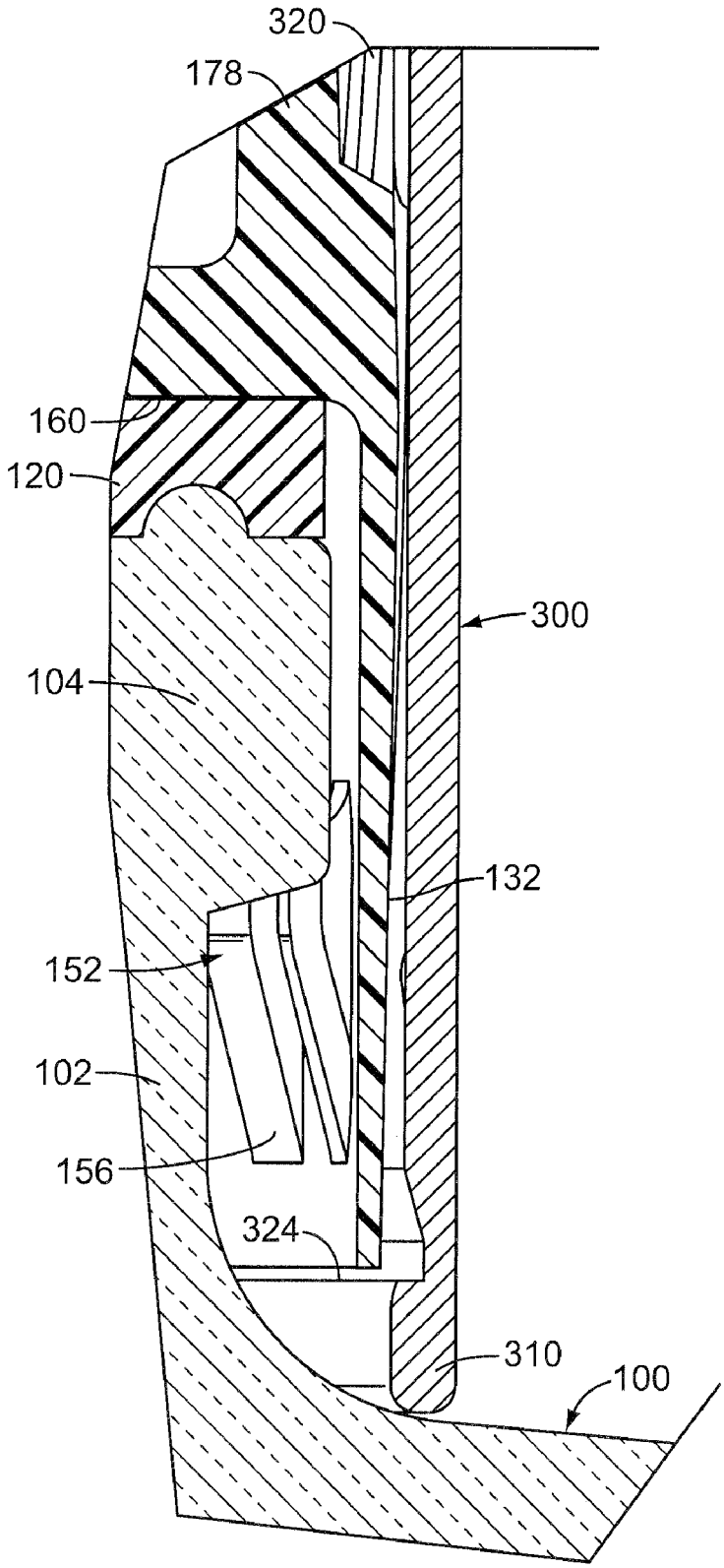
FIG. 39 is a fragmentary, even more greatly enlarged, cross-sectional view of a right-hand portion of the dispensing pump assembly and bottle shown in FIG. 38.

FIGS. 1-3 illustrate a first embodiment of the present invention which consists of a dispensing assembly 90 for mounting to a container or receptacle 100. The illustrated receptacle 100 is shown in one preferred form as a conventional, transparent, glass bottle suitable for containing a liquid perfume. As best illustrated in the exploded view of FIG. 3, the container 100 includes a neck 102 with an outwardly projecting rim, lip or flange 104 at its upper end. The top of the bottle flange 104 has an upwardly projecting, annular sealing bead 105 (see FIGS. 3 and 19).

A suitable dispensing module 106, such as previously discussed, includes a pump cartridge 108, a dip tube 110, and an upwardly biased stem 112 on which an external actuator button 114 is disposed. (The dip tube 110 is illustrated in FIGS. 1 and 2 as visible as would be the case with a transparent or translucent container 100). It will be appreciated by those skilled in the art that a user may press down on the button 114 in order to operate the pump cartridge 108 whereby fluid in the container 100 is pumped up through the dip tube 110 and stem 112 and dispensed as a fine mist spray out the opening in the actuator button 114.

In one preferred form, a gasket 120 (preferably molded from a plastic rubber), ferrule 122 and collar 124 function to secure the assembly to the container 100 as described in greater detail below. A removable dust cap or overcap 126 (see FIGS. 2 and 3) is also provided for decorative design as well as to protect the actuator button 114 and prevent inadvertent dispensing of the product.

The ferrule 122 of the first embodiment is illustrated in detail in FIGS. 4-10, and may be advantageously molded of a durable but somewhat resilient, plastic material (e.g., polypropylene).

Figure 7:
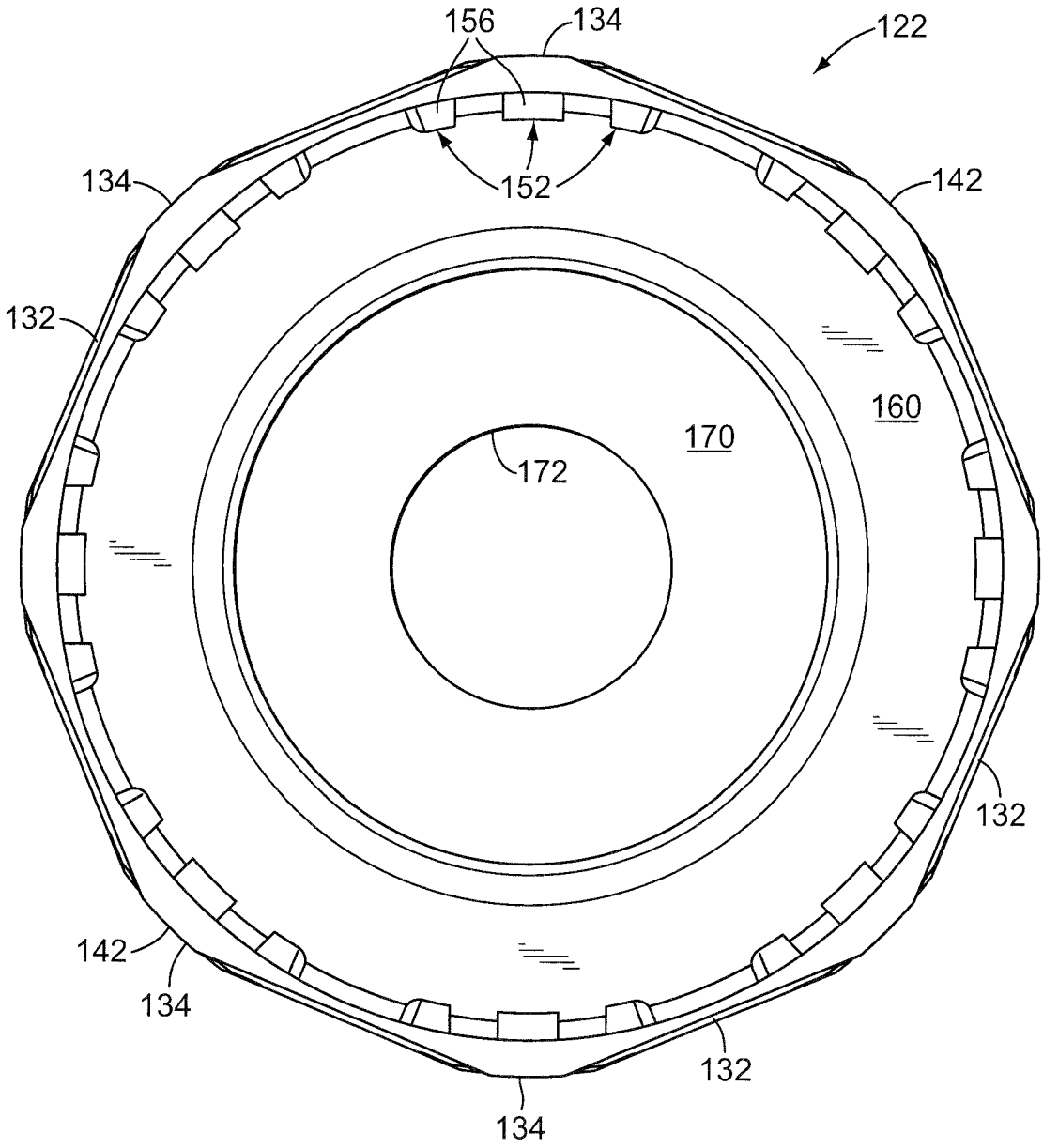
FIG. 7 is a bottom view of the ferrule shown in FIG. 4.
Figure 8:
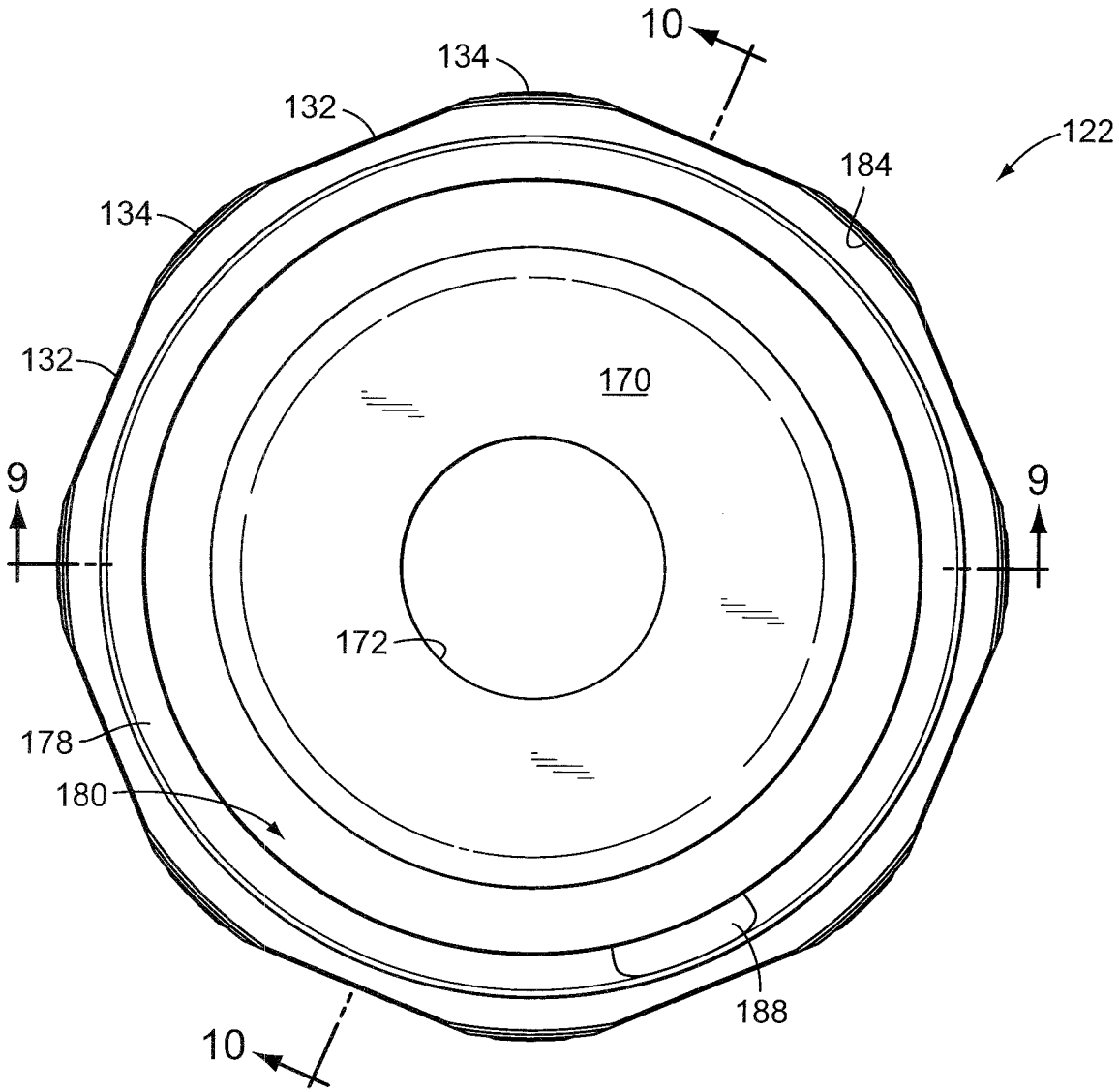
FIG. 8 is a top, plan view of the ferrule shown in FIG. 4.

The ferrule 122 includes a lower skirt 130 having an outer surface which is generally a regular polygon in cross-section, and in the illustrated embodiment is generally octagonal with eight generally flat surfaces 132 connected at eight outwardly projecting, somewhat cut-off corners 134 (see, e.g., FIGS. 7 and 8). The skirt 130 may advantageously be continuous, although it should be appreciated that a ferrule 122 in which the skirt 130 is slit, particularly in the flat surfaces 132, could also be used with the present invention.

Figure 9:
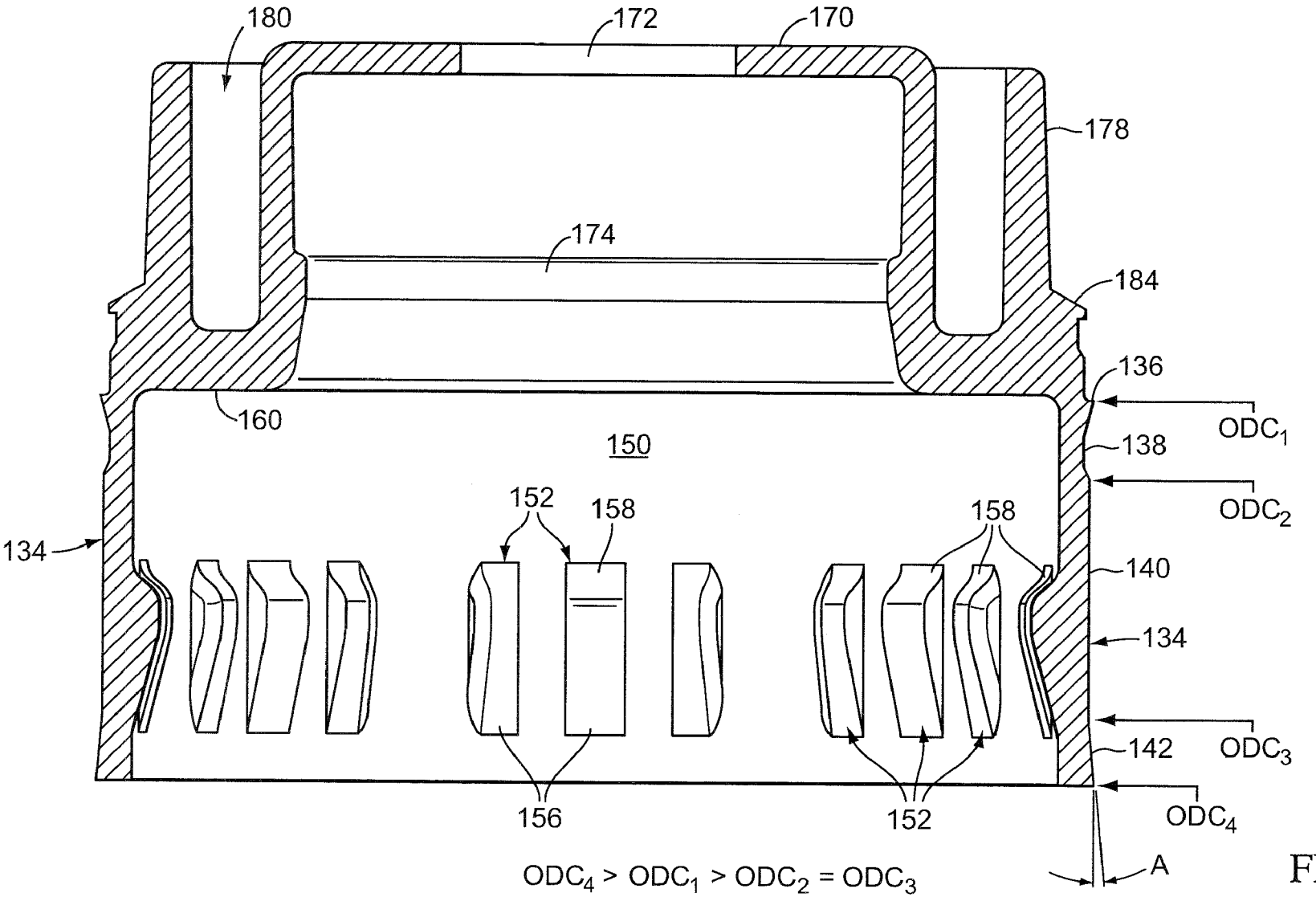
FIG. 9 is an enlarged, cross-sectional view taken generally along the plane 9-9 in FIG. 8 (i.e., across two, diametrically opposite corners)
Figure 10:
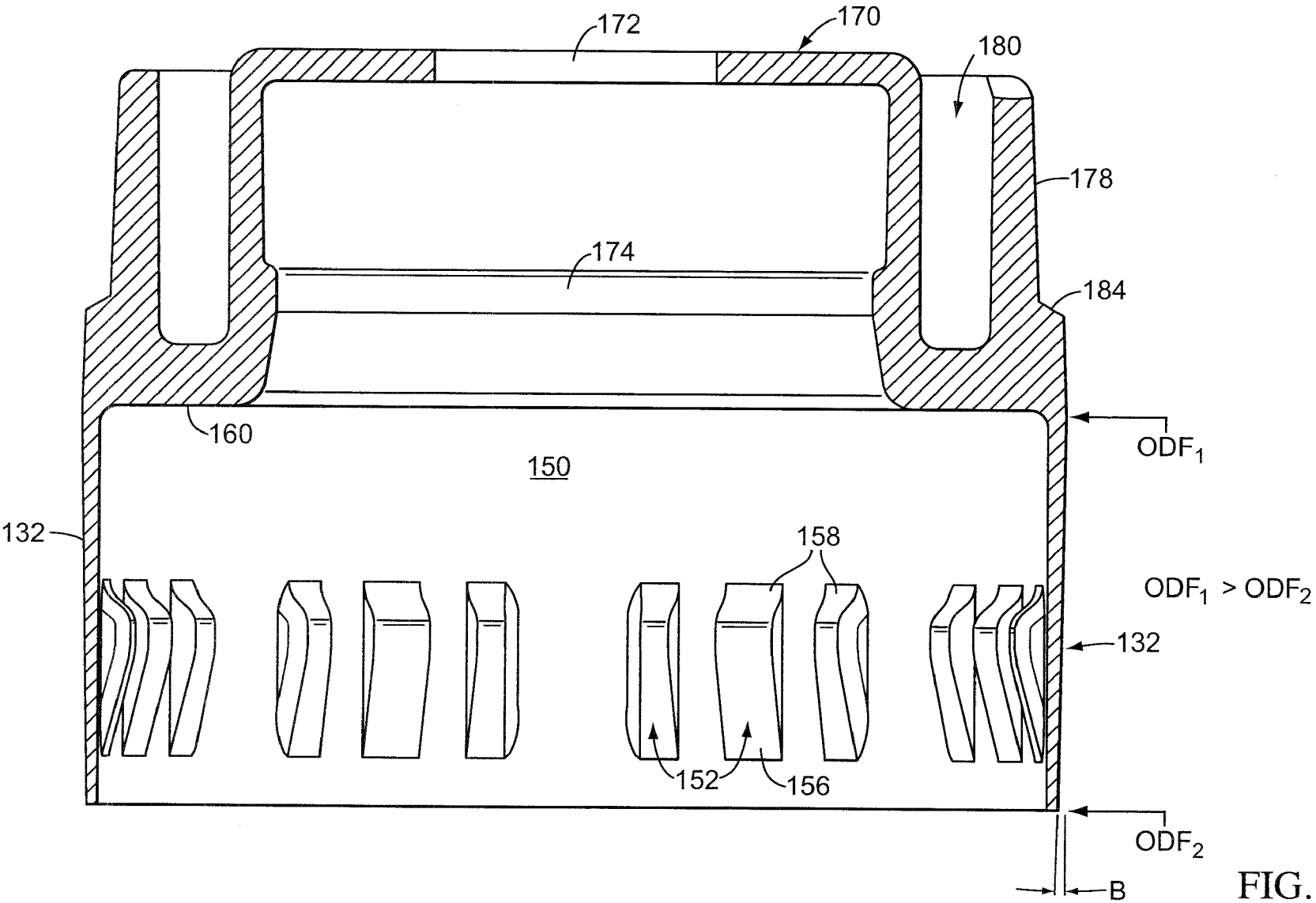
FIG. 10 is an enlarged, cross-sectional view taken generally along the plane 10-10 in FIG. 8 (i.e., across two, diametrically opposite flat regions between the corners)
Figure 11:
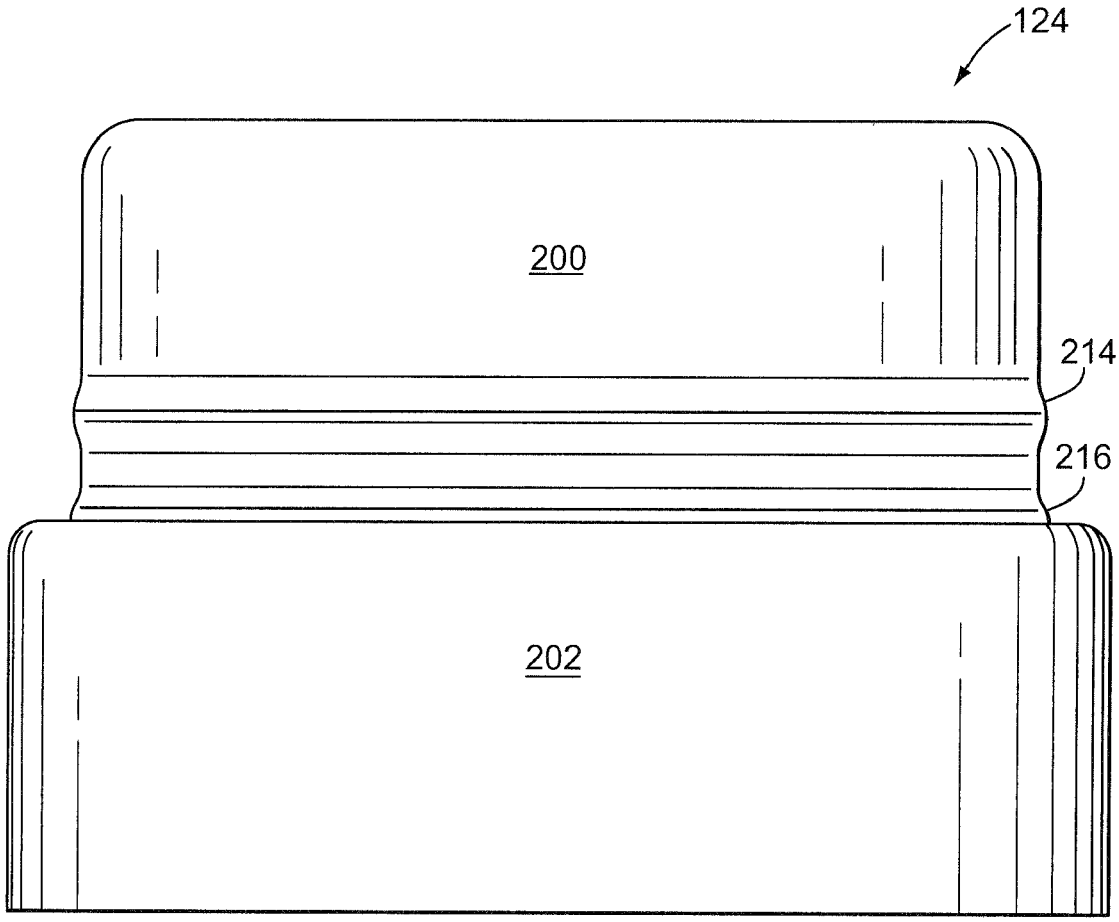
FIG. 11 is a side, elevational view of the metal collar employed in the first embodiment of the dispensing pump assembly shown in FIG. 3.
Figure 12:
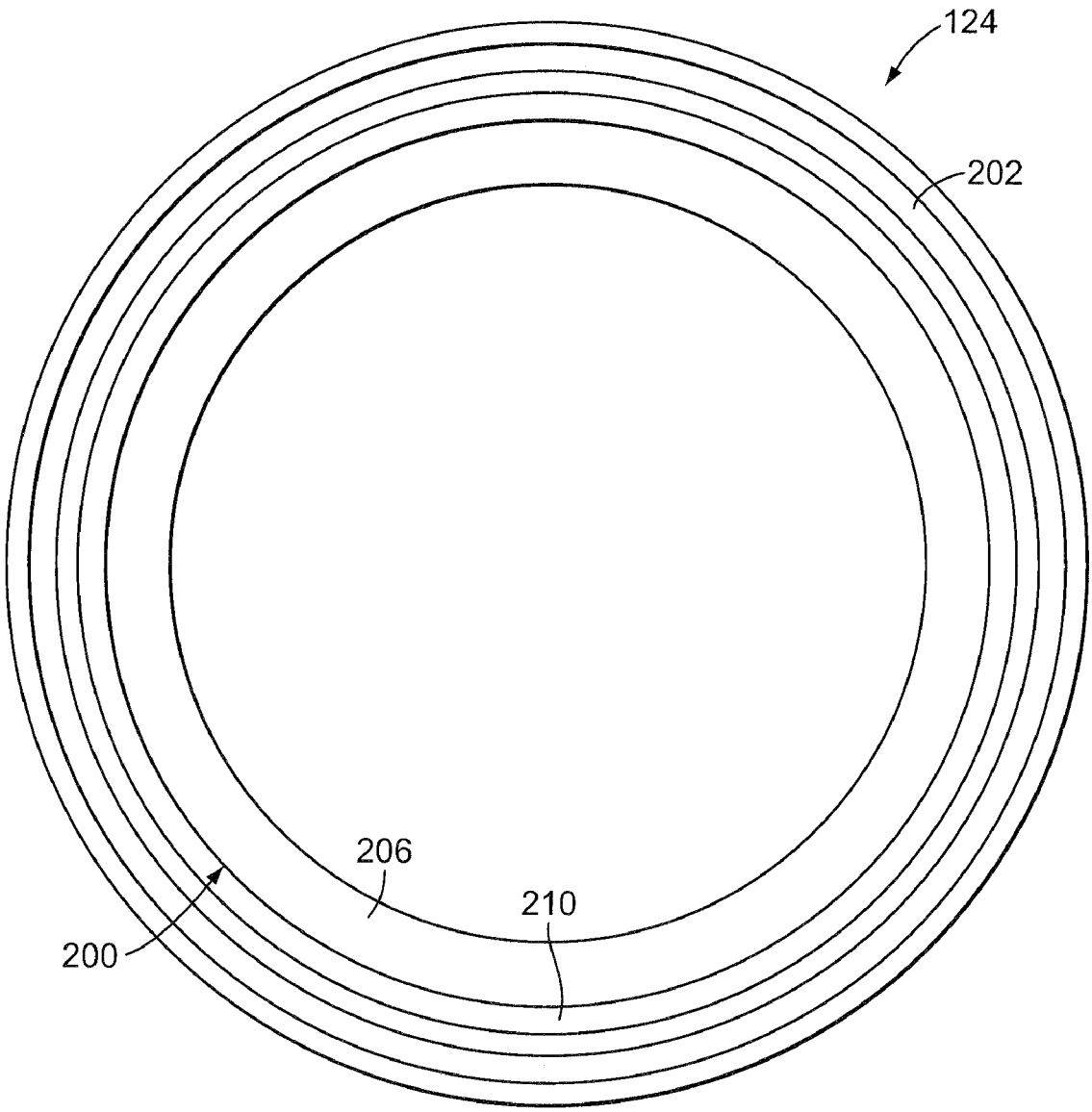
FIG. 12 is a bottom view of the collar shown in FIG. 11.
Figure 13:
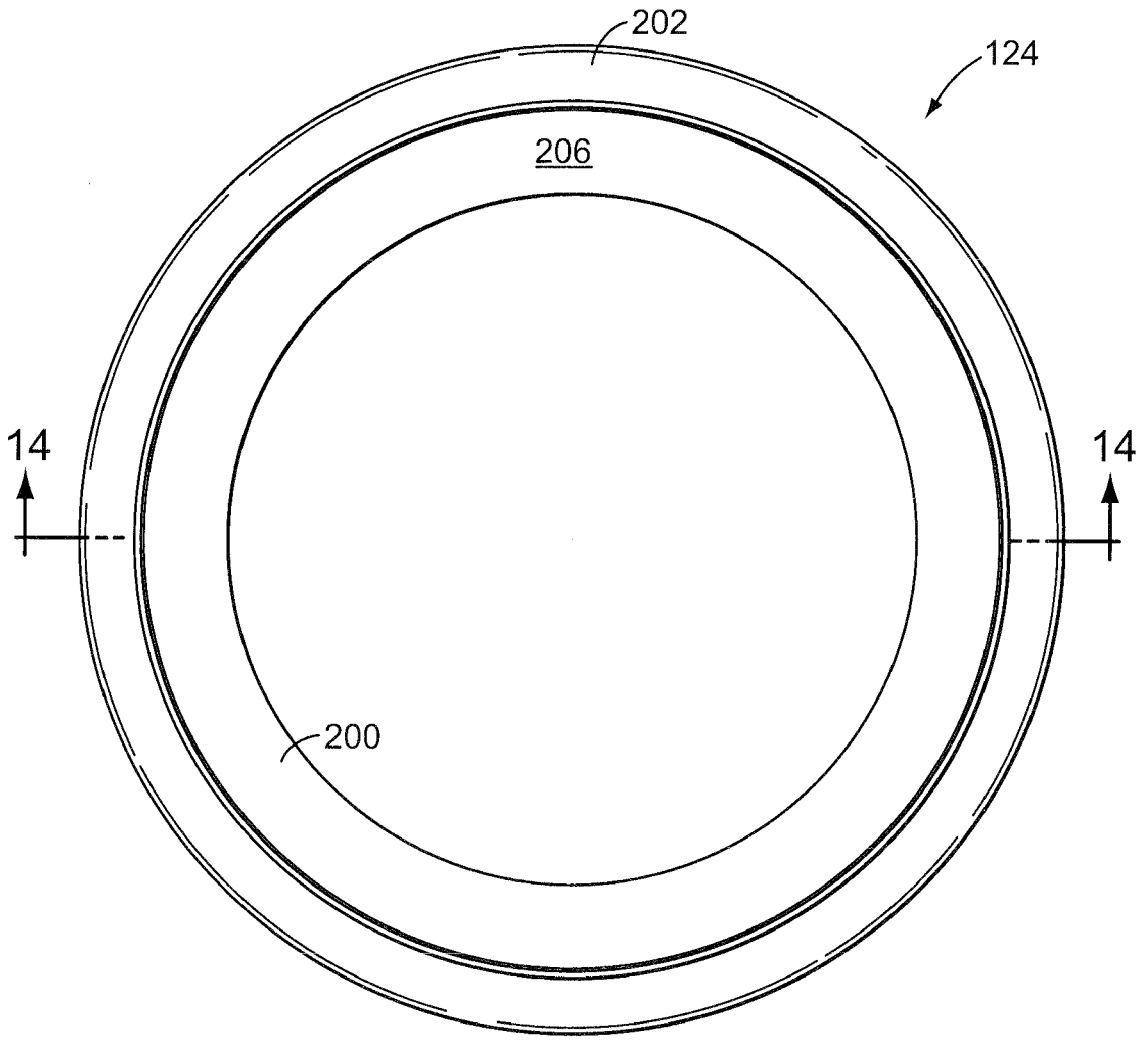
FIG. 13 is a top, plan view of the collar shown in FIG. 11.

As best illustrated in FIG. 9, the outer surface of the skirt 130 at each of the corners 134 has, at the upper end, a lip 136 having an outer diameter $ODC_1$ with recessed area 138 beneath the lip 136. A generally flat and axially extending surface 140 extends below the recessed area 138 (where the outer diameters at the top and bottom are the same: $ODC_2=ODC_3$). The bottom portion 142 of the skirt corners 134 are tapered outwardly at an angle A (see FIG. 9) whereby the outer diameter at the bottom $ODC_4$ is slightly greater than the outer diameter $ODC_3$ of the axially extending surface 140 thereabove. As illustrated in FIG. 10, the flat surfaces 132 of the ferrule 122 between the corners 134 may be slightly tapered inwardly from top to bottom (e.g., by the angle B as illustrated in FIG. 10, where the outer diameter at the top of the skirt $ODF_1$ is greater than the outer diameter at the bottom of the skirt $ODF_2$ owing to the taper angle B).

The inner surface 150 of the skirt 130 is, by contrast, generally cylindrical (see FIG. 7) with elongated ribs or nibs 152 projecting inwardly therefrom. Specifically, as best seen in FIGS. 7, 9 and 10, sets of three nibs 152 are provided at each corner 134, where each nib 152 includes a lower face 156 which tapers in toward the axial center of the ferrule 122 from the bottom at a point spaced above the bottom of the skirt 130, and includes a less tapered upper shoulder 158.

The internal diameter of the ferrule 122, the distance each nib 152 projects inwardly, and the heights of the nib surfaces 156 and 158 are determined by the size and type of bottle flange 104 on which the ferrule 122 is to be mounted. For example, in the perfume pump spray bottle industry, different bottle flange sizes are provided according to industry standards such as GPI and FEA.

The exterior configuration and size of the ferrule 122 can be constant regardless of the interior size and configuration of the ferrule 122. Thus, the design of the exterior of the ferrule 122 and the design of the collar 124 can remain the same regardless of the type and size of the bottle on which the dispensing assembly is to be installed.

The ferrule 122 includes a deck or downwardly facing shoulder 160 extending inwardly from the upper end of the skirt 130, which shoulder 160 is adapted for seating against the gasket 120 on the top of the container neck 102 (see FIGS. 3 and 19) when assembled as further described below.

In many instances, the hardness of the material of the ferrule 122 desired to ensure that the ferrule 122 will be properly retained on the container neck 102 as described in detail herein will be such that a softer gasket 120 may be advantageously used as described and shown to ensure a proper seal. However, if the ferrule deck 160 is capable of forming an adequate seal on top of the container neck 102, the gasket 120 may be omitted. Therefore, it should be recognized that it would be within the scope of the present invention to provide a ferrule 122 which itself has sufficient softness to provide a desired seal without inclusion of a separate gasket.

A generally cylindrical turret or cap portion 170 (FIG. 10) with a central opening 172 extends up from the ferrule shoulder 160 and includes a reduced diameter portion 174 on its inner surface. It should be appreciated that the pump cartridge 108 may be secured in the cap portion 170 with the flange 176 (see FIGS. 3 and 19) of the cartridge 108 trapped above the reduced diameter portion 174 with the stem 112 extending through the central opening 172. A concentric outer lip 178 also extends up from the shoulder 160 and surrounds the cap portion 170 to define an annular space 180 therebetween, and a lower skirt on the actuator button 114 may be guided within the space 180, and protected, during reciprocating pumping movement of the actuator button 114 (see FIG. 19).

An outer shoulder or lip 184 defining outwardly extending lips at the corners above the ferrule skirt 130 is also provided to facilitate assembly as described hereinafter.

A notch 188 (FIG. 4) may also be provided in the upper end of the outer lip 178 to accommodate the mold gate for the injection of the thermoplastic resin during molding of the ferrule 122.

Figure 14:
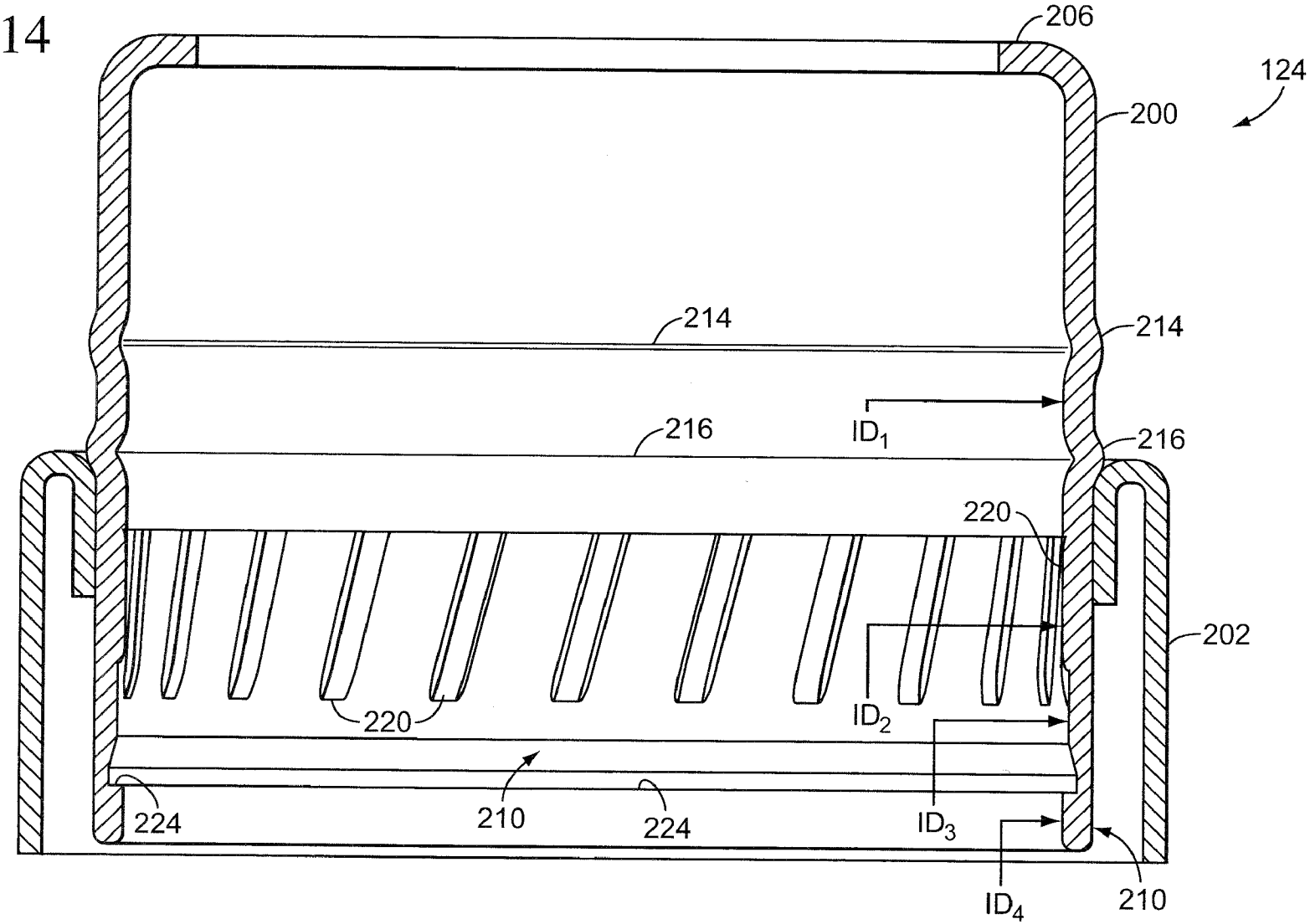
FIG. 14 is an enlarged, cross-sectional view taken generally along the plane 14-14 in FIG. 13.

The metal collar 124 of the embodiment of FIGS. 1-3 is illustrated in FIGS. 11-14 wherein, as best seen in FIG. 14, the collar consists of two parts: an inner mounting collar 200 and an outer decorative collar 202 which is secured thereon. Both collars 200, 202 may be made from aluminum or other suitable materials. Once the present invention is understood, it will be appreciated by those skilled in this art that the collar 124 may in one form be a single annular metal piece, and in another form may be a subassembly, such as illustrated, of two separate pieces (200, 202) which are mechanically staked together to form a single, integral subassembly for mounting on the ferrule 122 in a process described in detail hereafter.

As can be seen in FIG. 14, the mounting collar 200 is generally cylindrical with an inwardly extending lip 206 at its upper end and a Nomar edge 210 at its lower end. A pair of spaced annular ridges 214, 216 extend around the mounting collar 200 above the decorative collar 202 to define a groove within which the cap 126 (see FIGS. 2 and 3) may be snapped in order to be secured thereon (see FIG. 15). Also provided around the lower portion of the mounting collar 200 are a plurality of discrete ribs 220 which project inwardly from the inner surface of the collar 200 and extend generally axially but at an angle of, for example, about 15° (±5°) from the axial direction.

As indicated in FIG. 14, the inner diameter of the mounting collar 200 between the annular ridges 214, 216 is $ID_1$. Further, the general inner diameter of the lower portion of the mounting collar 200 is $ID_3$, with the ribs 220 projecting inwardly to an effective inner diameter (between two diametrically opposite ribs) of $ID_2$. As will be understood by those skilled in the art, the Nomar edge 210 at the lower end of the mounting collar 200 consists of a thinned annular portion above a thickened bottom annular portion (formed by bending up the bottom edge of the thinner, lower portion of the collar). Above the thickened bottom annular portion on the inside of the collar 200 there is a recess which, accordingly, has an increased inner diameter so that the thickened bottom annular portion has a smaller inner diameter $ID_4$ so as to define an upwardly facing shoulder 224 that presents an annular face facing toward the top end of the collar 200.

Figure 15:
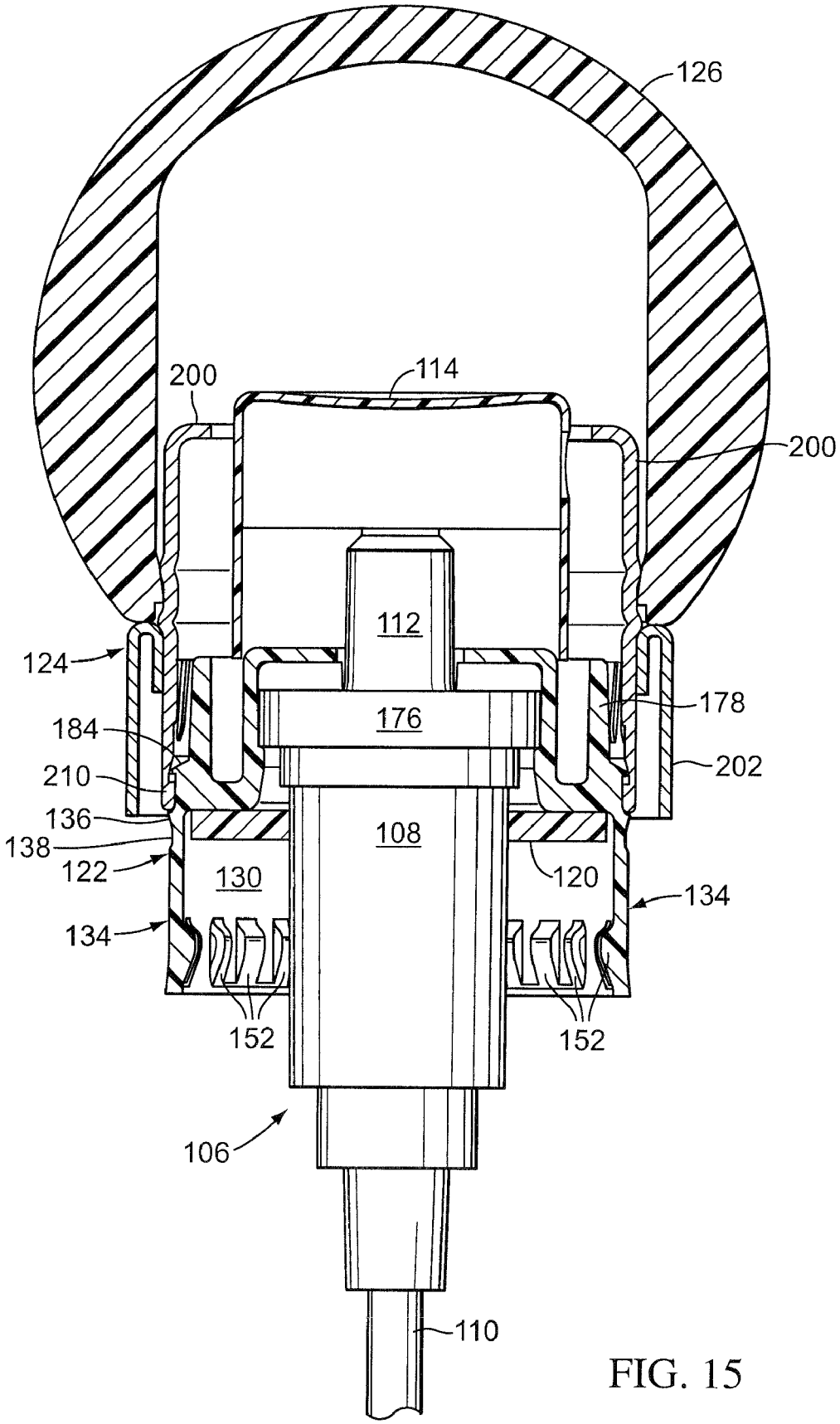
FIG. 15 is an enlarged, fragmentary, longitudinal, cross-sectional view of the first embodiment of the dispensing pump assembly components in an assembled shipping configuration prior to mounting on the bottle, except that FIG. 15 shows the internal dispensing pump cartridge and dip tube in a side, elevational view.
Figure 16:
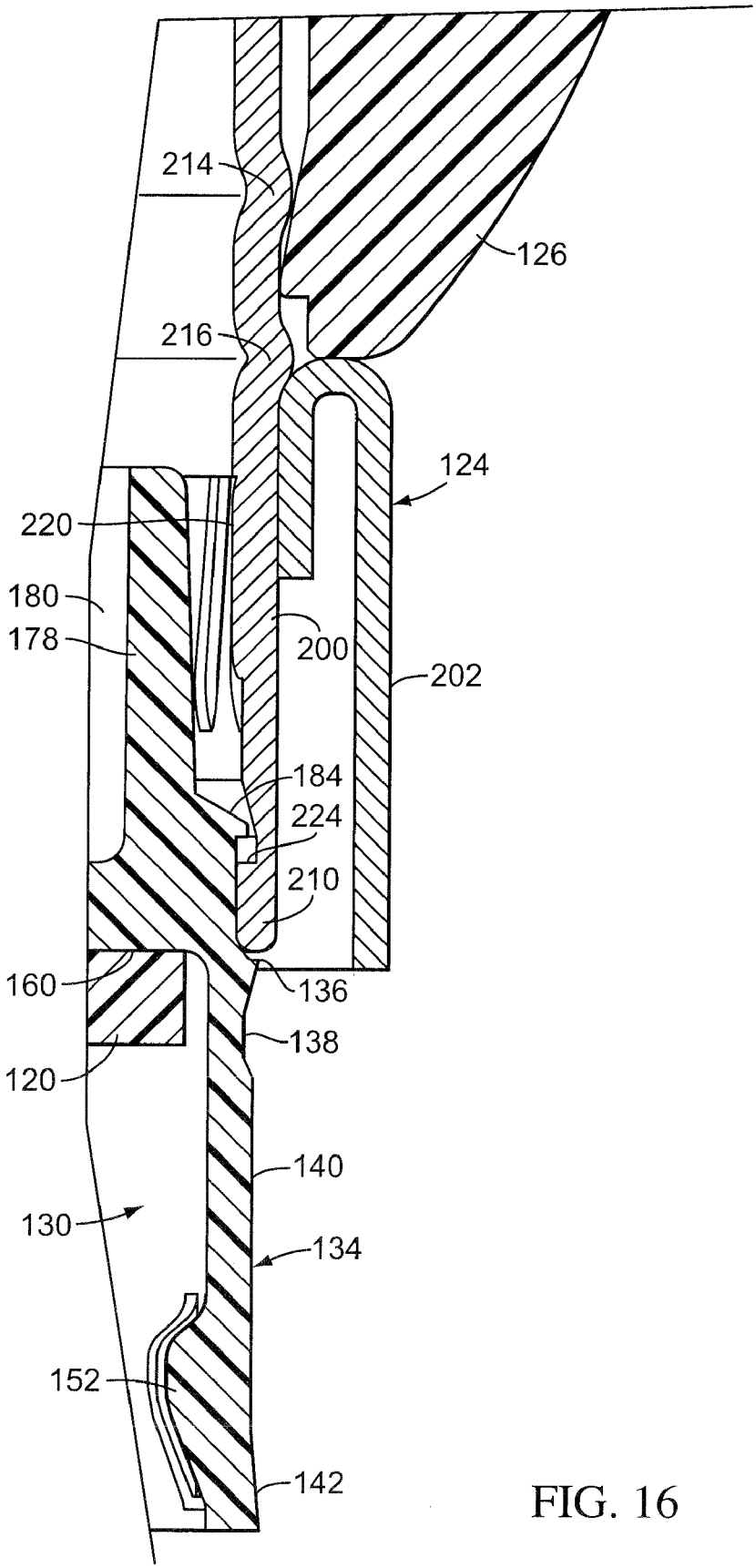
FIG. 16 is a fragmentary, greatly enlarged, cross-sectional view of a right-hand portion of the dispensing pump assembly shown in FIG. 15.
Figure 17:
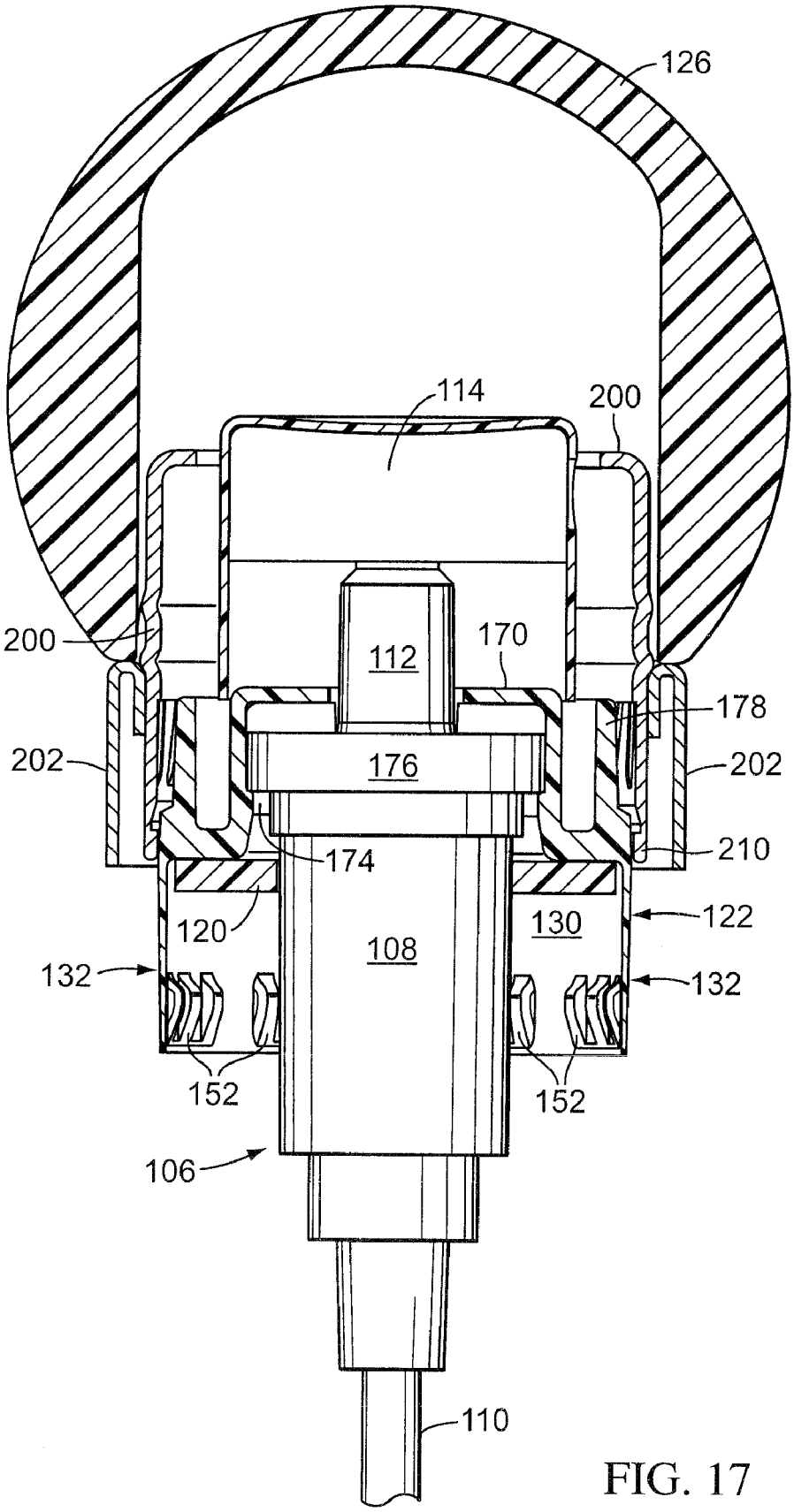
FIG. 17 is an enlarged, fragmentary, longitudinal, cross-sectional view of the first embodiment of the dispensing pump assembly components in an assembled shipping configuration prior to mounting on the bottle, except that FIG. 17 shows the internal dispensing pump cartridge and dip tube in a side, elevational view.
Figure 18:
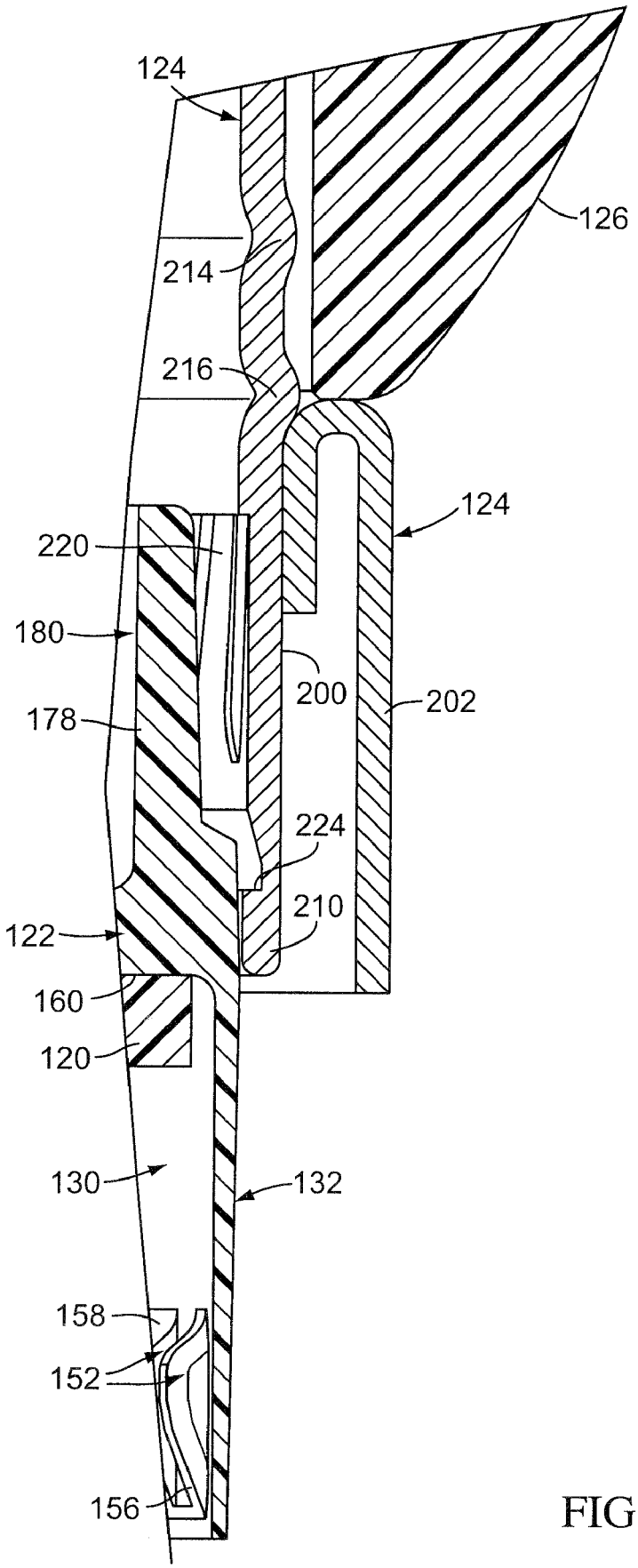
FIG. 18 is a fragmentary, greatly enlarged, cross-sectional view of a right-hand portion of the dispensing pump assembly shown in FIG. 17.

Reference will now be had to FIGS. 15-18, in which the above described components are illustrated as assembled but prior to mounting on a container 100. In this condition, it should be appreciated that the components are in substantially the same relative orientation to one another that they will be when finally assembled on a container 100 except that the mounting collar 200 is snap fit in a raised position relative to the ferrule 122. In this raised (shipping) position, the collar 124 is only partially pushed onto the ferrule 122 with the bottom (Nomar) edge, at the corners 134, secured to the ferrule 122 between the lip 136 and the outer lip 184 (see FIG. 9) as seen in FIGS. 15 and 16. At the flat surfaces 132 between the corners 134, the lower end of the mounting collar 200 may be spaced from the outer surface of the ferrule 122 as shown in FIGS. 17 and 18. (The gasket 120 may be stretched to fit over the pump cartridge 108 whereby it is frictionally held thereon as illustrated.) These Figures illustrate a shipping position in which the components are secured together in an assembled condition and can be handled by a customer to securely mount the assembly to the customer's filled container 100 as further described hereafter.

Mounting of the dispensing assembly 90 to a container 100 will now be described, such mounting being illustrated in FIGS. 19-24.

Specifically, advantageously according to the present invention, the ferrule 122 is pushed down over the bottle neck 102 during initial assembly, at which time the nibs 152 are first forced outwardly (by compression of the nibs 152 and stretching of the skirt 130) in order to pass over the bottle flange 104 at the upper end of the bottle neck 102. While the size of the bottle flange 104 may vary for different bottles 100 and may also vary due to manufacturing tolerances, the compression of the gasket 120, and the elasticity of the ferrule skirt 130 and nibs 152 cause the nibs 152 to move radially inwardly under the bottle flange 104 at the end of the initial phase of the mounting process. This occurs generally when the lower faces 156 of the nibs 152 pass below the bottle flange 104, at which point the upper shoulder 158 of the nibs 152 will either move under the bottle flange 104 or move under by compressing somewhat to provide some gripping or holding force preventing the ferrule 122 from being removed from the bottle neck 102.

The mounting process may be effected entirely by automated equipment or partly manually. In either case, the process begins with the assembled components (as in FIGS. 15-18) provided to a bottler (typically, however, without the cap 126 thereon during mounting). If a partially manual process is employed to mount the dispensing assembly 90 on the container 100, then the ferrule 122 (with gasket 120, dispensing module 106, and initially positioned collar 124) are manually pushed onto the neck of a filled container 100 (such as a bottle) at a first work station. During this step, the collar 124 does not move relative to the ferrule 122 so that the collar 124 remains in the "up" position between the ferrule lips 184 and 136 as shown in FIG. 15. The ferrule 122 and collar 124 thus move downwardly together on the bottle flange 104. The snap-fit engagement of the ferrule 122 with the bottle neck flange 104 maintains the assembly 90 in position on the bottle 100 while the bottle 100 is moved to a second work station at which a mechanical plunger device is operated to hold the bottle 100 and push the metal collar 124 all the way down on the ferrule 122. Because the outside diameters of portions of the ferrule 122 are greater than some inner diameters of portions of the collar 124 as described above, portions of the ferrule 122 are compressed and deformed inwardly (and, to a small extent, the collar 124 may stretch radially outwardly) as a tight, interference fit is established.

In a fully automatic mounting process, the assembly of the gasket 120, dispensing module 106, ferrule 122, and collar 124 may be pushed down on the bottle 100 in one continuous motion by a spindle. The spindle exerts an initial force (e.g., 30 to 40 pounds) on the top of the collar 124 so that the collar 124 and ferrule 122 move together until the bottom of the ferrule 122 initially snaps down over the bottle flange 104 and can be pushed down no further as previously described. The spindle then exerts a greater force (e.g., 40 to 80 pounds) in the final phase of mounting so that the collar 124 is then moved all the way down relative to the ferrule 122 so as to completely surround the exterior side of the ferrule 122 as shown in FIGS. 19-24 and further described below.

Specifically, when the collar 124 is pushed over the ferrule 122 during the final phase of the mounting on a bottle neck 102, the bottom of the Nomar edge 210 of the collar 124 initially pushes down on the lip 136 at the corners 134 of the skirt 130, distorting the lip 136 and pushing its material down around the outside of the skirt. The recessed area 138 beneath the lip 136 provides a space into which the lip material can be deformed so that, once a sufficient force is applied to the collar 124 during mounting to distort the lip 136 and begin moving the collar 124 down over the ferrule 122 as desired, the deformed material of the lip 136 will thereafter provide little hindrance to the collar 124 as the collar 124 continues to be pushed over the ferrule 122. As a result, the collar 124 can be pushed down with a sufficient, but not excessive, vertical installation force (e.g., less than 100 pounds, such as 80 pounds in one proposed commercial design) which will not risk damaging the collar 124 or container 100 in the process.

As the collar 124 continues to be pushed down over the ferrule 122 during the final mounting phase, it squeezes the outer surface of the ferrule 122 inwardly against the radial outward surface of the bottle flange 104. While this will involve some squeezing inwardly of the nibs 152 to a position which is further under the bottle flange 104 compared to the initial phase of the mounting, the nibs 152 are already generally under the bottle flange 104 after the initial mounting phase as previously described.

In the fully mounted configuration as shown in FIGS. 19-24, the collar 124 has been pushed all the way down over the ferrule 122 so that the Nomar edge 210 is beneath the bottom edge of the ferrule skirt 130, with the skirt elastically expanded outwardly so that it is above the upwardly facing shoulder 224 of the Nomar edge 210. In this position, the nibs 152 are secured by the surrounding substantially rigid collar 124 underneath the bottle flange 104 whereby the mounted dispensing assembly 90 is securely retained on the bottle neck 102. While some buckling of the flat surfaces 132 of the ferrule skirt 130 may result in portions of the skirt 130 being positioned below the bottle flange 104, it is the nibs 152 which substantially retain the assembly 90 on the bottle neck 102.

Further, in addition to the interference between the Nomar edge shoulder 224 and the bottom of the ferrule 122 (particularly at the skirt corners where the bottom portions 142 are tapered outwardly) which secures the collar 124 from being slid back up off the ferrule 122 after mounting, it should be appreciated that the ribs 220 on the inner surface of the collar 124 will also secure the collar 124 on the ferrule 122, as the ribs 220 press into the outer surface of the ferrule skirt 130 (at least at the corners 134), providing not only a friction connection but also, due to their slight angle relative to the axial direction, an interference against the collar 124 being pulled axially off the ferrule 122. Moreover, such angled orientation of the ribs 220 enables the ribs 220 to be slid down relatively easily (and possibly slightly "screwed on") during the final phase of the mounting process without requiring that an undesirably excessive mounting force be applied to the collar 124. Once fully mounted, cold flow or creep of the plastic material of the ferrule 122 around the ribs 220 will further facilitate long term holding of the collar 124 on the ferrule 122.

By way of example, the following previously discussed dimensions have been found to be suitable for a ferrule 122 and collar 124 combination such as described above for mounting on a conventional glass bottle 100 (e.g., FEA design) having a flange 104 with a nominal outside diameter which is (a) greater than an effective inner diameter between two diametrically opposite ferrule nibs 152 of 14.70 mm±0.20 and (b) no greater than an inside diameter of the ferrule skirt 150 of 15.60 mm±0.13, for example, a bottle neck 104 having a nominal outside diameter of 15 mm:

FIG. 9 (ferrule 122 at corners 134):
Angle A=20° (18° to 25°)
$ODC_1$=16.73 mm±0.08
$ODC_2$=16.60 mm±0.10
$ODC_3$=16.60 mm±0.10
$ODC_4$=17.10 mm±0.10
FIG. 10 (ferrule 122 at flat surfaces 132):
Angle B=1° Reference
$ODF_1$=16.18 mm±0.15
$ODF_2$=15.95 mm±0.15
FIG. 14 (collar 124):
$ID_2$:=16.08 mm
$ID_2$=16.08 mm±0.03
$ID_3$=16.33 mm±0.03
$ID_4$=16.13 mm Of course, still other dimensions could be used within the scope of the present invention depending upon the size of the bottle neck with which the dispensing assembly is used, and the above dimensions are stated merely for illustration purposes and to provide an indication of one set of relative sizes which have been found suitable to provide the advantageous mounting features as described herein.

FIGS. 25-39 illustrate an alternate embodiment of a dispensing module 90A also incorporating aspects of the present invention. In this embodiment, the components may be the same as in the first described embodiment except that a different collar 300 is used, without an overcap. Accordingly, the same reference numerals are used in the FIGS. 25-39 as used to describe the same components in FIGS. 1-24 and repetition of the details of those same components will not be made here. With respect to the different collar 300, comparable elements will be identified by comparable reference numbers as used in FIGS. 1-24 but with 100 added (e.g., the ribs 220 in FIG. 14 are identified as ribs 320 where appropriate in FIGS. 25-39).

Specifically, the modified metal collar 300 is shown in particular in FIGS. 26-29, and is essentially simplified from the collar 124 of the first embodiment by providing a substantially cylindrical outer surface without annular ridges for mounting an overcap. This simpler configuration (with a longer straight cylindrical portion) provides a smooth aesthetic appearance to the entire collar 300 (which is not covered by an overcap), and also permits the internal ribs 320 to be longer as well (see FIG. 29). As a result, the friction between the ribs 320 and the ferrule 122 may be increased, as may the interference against axially pulling the fully mounted collar 300 off the ferrule 122, even though the ribs 320 extend up above the engaged outer surface of the ferrule 122 and therefore at their upper end are not enclosed by creep of the ferrule 122. Moreover, while this design may permit the collar 300 to be more readily twisted and pulled off if necessary for some unusual reason, such removal would still not be easy given the interference between the bottom of the ferrule skirt and the collar Nomar edge 310. Further, given the slight angle of the ribs 320, while this configuration would facilitate appropriate removal if necessary by a manufacturer with knowledge of the rib configuration, it would be unlikely to be accomplished by an individual who would be unlikely to apply the correct combined degrees of pulling and twisting which would be required to accomplish such removal.

Accordingly, should be appreciated that the present invention permits easy and reliable assembly of a dispenser assembly 90, and further permits easy and reliable mounting of the assembly 90 on a container 100. Moreover, the present invention significantly reduces the likelihood that the dispenser assembly 90 will inadvertently or undesirably become decoupled from the container 100. In particular, the assembly 90 can be properly installed without requiring an excessive installation force—yet the installed configuration provides a greatly increased resistance to removal (owing significantly to the interference between the bottom of the ferrule corners 134 and the Nomar edge shoulders 224, 324 (FIGS. 20 and 35)).

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

What is claimed is:

1. Components for mounting on a receptacle having a neck and a flange to secure a dispensing assembly for dispensing a substance from the receptacle, comprising:

a ferrule adapted to maintain a coupling of a dispensing module to the receptacle, the ferrule including a shoulder member securable to said dispensing module, a skirt defining an aperture open on one end, wherein said dispensing module extends through said aperture when secured to said shoulder member, said skirt having a lip on the ferrule outer surface adjacent said other end of said ferrule skirt, and a recess in said ferrule skirt adjacent said lip, said recess being between said lip and said ferrule skirt other end; and a substantially rigid annular collar adapted to be positioned over said ferrule skirt outer surface when said ferrule is mounted on said receptacle, said collar being open on one end, and at the portion of said collar positioned over said lip and recess when said collar is position thereover, having a substantially axially flat inner surface;

wherein said lip extends to a diameter greater than the diameter of said collar one end and to a diameter greater than the diameter of said recess therebeneath whereby said lip is pushed axially down and radially inward into said recess when said collar is pushed over said ferrule.

2. The dispensing assembly components of claim 1, wherein said lip comprises projections spaced around the outer surface of the skirt.

3. The dispensing assembly components of claim 1, wherein the collar is made of aluminum, and said skirt is plastic.

4. A method of securing the dispensing assembly components of claim 1 to the receptacle neck and flange, comprising:

supporting said collar one end on said ferrule lip;

locating the ferrule on the receptacle flange with said dispensing module extending into said receptacle;

pushing the ferrule over the receptacle flange to move both said collar and said ferrule over said receptacle flange; and pushing said collar over said ferrule skirt whereby said collar pushes the material of said ferrule lip into said recess beneath said lip.

5. Components for mounting on a receptacle having a neck and a flange to secure a dispensing assembly for dispensing a substance from the receptacle, comprising:

a ferrule adapted to maintain a coupling of a dispensing module to the receptacle, the ferrule including a shoulder member securable to said dispensing module, a skirt which is generally annular about an axis and defines an axial aperture open on one end, wherein said dispensing module extends through said aperture when secured to said shoulder member, said skirt having a lip on the ferrule outer surface adjacent said other end of said ferrule skirt, a recess beneath and adjacent said lip, and nibs extending from the inner surface of said skirt toward said axis;

a substantially rigid annular collar having a generally annular inner surface adapted to be positioned over said ferrule skirt outer surface when said ferrule is mounted on said receptacle, said collar being open on one end and having an inwardly extending annular flange on the other end, and said collar inner surface including an annular recess adjacent said open end defining an annular face facing said collar other end, and at the portion of said collar positioned over said lip and recess when said collar is position thereover, having a substantially axially flat inner surface;

wherein said open one end of said ferrule skirt extends radially outwardly into said annular recess of said collar inner surface when said dispensing assembly is mounted on the receptacle, and said lip extends to a diameter greater than the diameter of said collar one end and to a diameter greater than the diameter of said recess therebeneath whereby said lip is pushed into said recess when said collar is pushed over said ferrule.

6. The dispensing assembly components of claim 5, wherein said lip comprises projections spaced around the outer surface of the skirt.

7. The dispensing assembly components of claim 5, wherein said annular recess is conically tapered outwardly toward said collar open end, and further comprising at least portions of said ferrule skirt outer surface tapered conically outwardly, wherein said ferrule skirt outer surface portions extend into said collar annular recess when said dispensing assembly is secured to the receptacle.

8. The dispensing assembly components of claim 5, further comprising a dispensing module secured to said ferrule.

9. The dispensing assembly components of claim 5, wherein said collar has a Nomar edge that is located at said open end and defines said recess and said annular face.

10. The dispensing assembly components of claim 5, wherein the collar is made of aluminum.

11. The dispensing assembly components of claim 10, wherein said skirt and nibs are plastic.

12. A method of securing the dispensing assembly components of claim 6 to the receptacle neck and flange, comprising:

supporting said collar one end on said ferrule lip;

locating the ferrule on the receptacle flange with said dispensing module extending into said receptacle;

pushing the ferrule over the receptacle flange to move both said collar and said ferrule relative to said receptacle flange to locate said ferrule nibs beneath said receptacle flange; and pushing said collar over said ferrule skirt whereby said collar first pushes the material of said ferrule lip into said recess beneath said lip and then traps said nibs beneath said flange and traps said lip in said recess beneath a portion of said collar having a substantially axially flat inner surface.

13. The method of claim 12, wherein in said ferrule locating step, a gasket is positioned between said ferrule shoulder member and said receptacle flange, and in said collar pushing step said collar is pushed sufficiently to compress said gasket.

14. The dispensing assembly components of claim 1, wherein said skirt adjacent the side of said recess opposite the lip extends to a diameter greater than said recess diameter.

15. The dispensing assembly components of claim 14, wherein said diameter of said skirt adjacent the side of said recess opposite the lip is less than the diameter of said skirt other end.

16. The dispensing assembly components of claim 5, wherein said skirt adjacent the side of said recess opposite the lip extends to a diameter greater than said recess diameter.

17. The dispensing assembly components of claim 16, wherein said diameter of said skirt adjacent the side of said recess opposite the lip is less than the diameter of said skirt other end.

18. Components for mounting on a receptacle having a neck and a flange to secure a dispensing assembly for dispensing a substance from the receptacle, comprising:

a ferrule adapted to maintain a coupling of a dispensing module to the receptacle, the ferrule including a shoulder member securable to said dispensing module, a skirt defining an aperture open on one end, wherein said dispensing module extends through said aperture when secured to said shoulder member, said skirt having a generally annular outer surface between its ends;

a lip extending outwardly from the ferrule outer surface adjacent said other end of said ferrule skirt, a recess in said ferrule skirt adjacent said lip, said recess being between said lip and said ferrule skirt other end, and wherein said lip and recess are spaced from said ferrule skirt one end and the skirt between said skirt one end and said recess has a diameter greater than the diameter of the recess; and a substantially rigid annular collar adapted to be positioned over said ferrule skirt outer surface when said ferrule is mounted on said receptacle, said collar being open on one end and at the portion of said collar positioned over said lip and recess when said collar is position thereover, having a substantially axially flat inner surface;

wherein said lip extends to a diameter greater than the diameter of said collar one end and to a diameter greater than the diameter of said recess therebeneath whereby said lip is pushed into said recess and trapped therein by said collar portion when said collar is pushed over said ferrule.

19. The dispensing assembly components of claim 18, wherein the collar is made of aluminum, and said skirt is plastic.

20. A method of securing the dispensing assembly components of claim 18 to the receptacle neck and flange, comprising:

supporting said collar one end on said ferrule lip;

locating the ferrule on the receptacle flange with said dispensing module extending into said receptacle;

pushing the ferrule over the receptacle flange to move both said collar and said ferrule over said receptacle flange; and pushing said collar over said ferrule skirt whereby said collar pushes the material of said ferrule lip into said recess beneath said lip.

* * * * *